US007088938B2

(12) United States Patent
Hashimoto et al.

(10) Patent No.: US 7,088,938 B2
(45) Date of Patent: Aug. 8, 2006

(54) SEAL MEMBER, DEVELOPING APPARATUS, PROCESS CARTRIDGE AND IMAGE FORMING APPARATUS

(75) Inventors: Koji Hashimoto, Shizuoka-ken (JP); Kinya Harada, Susono (JP); Susumu Nittani, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 10/878,600

(22) Filed: Jun. 29, 2004

(65) Prior Publication Data

US 2005/0095031 A1 May 5, 2005

(30) Foreign Application Priority Data

Oct. 31, 2003 (JP) ..... 2003-373697

(51) Int. Cl.
*G03G 15/08* (2006.01)

(52) U.S. Cl. ..... 399/103

(58) Field of Classification Search ..... 399/102, 399/103, 265, 175, 287, 353; 66/194; 442/318, 442/319; 428/92–94
See application file for complete search history.

(56) References Cited

U.S. PATENT DOCUMENTS

| | | | | |
|---|---|---|---|---|
| 3,836,421 | A * | 9/1974 | Terry et al. | 428/88 |
| 4,340,631 | A * | 7/1982 | Endo et al. | 428/89 |
| 4,741,942 | A * | 5/1988 | Swift | 428/82 |
| 5,029,316 | A * | 7/1991 | Koiso | 399/102 |
| 5,271,983 | A * | 12/1993 | Ise et al. | 428/92 |
| 5,303,008 | A * | 4/1994 | Kalyandurg et al. | 399/106 |
| 5,740,500 | A | 4/1998 | Hashimoto | 399/114 |
| 5,923,924 | A | 7/1999 | Hashimoto | 399/111 |
| 6,016,408 | A | 1/2000 | Hashimoto et al. | 399/27 |
| 6,044,235 | A | 3/2000 | Hashimoto | 399/99 |
| 6,101,352 | A | 8/2000 | Hashimoto et al. | 399/119 |
| 6,115,566 | A * | 9/2000 | Ohara et al. | 399/103 |
| 6,151,459 | A | 11/2000 | Hashimoto et al. | 399/27 |
| 6,246,853 | B1 | 6/2001 | Suzuki et al. | 399/262 |
| 6,496,667 | B1 | 12/2002 | Shiratori et al. | 399/103 |
| 6,537,640 | B1 * | 3/2003 | Nakamura et al. | 428/92 |
| 6,560,422 | B1 | 5/2003 | Kanno et al. | 399/106 |
| 6,681,086 | B1 * | 1/2004 | Sahara | 399/102 |
| 6,735,403 | B1 | 5/2004 | Kanno et al. | 399/103 |
| 6,739,161 | B1 * | 5/2004 | Ohara et al. | 66/194 |
| 2003/0091365 | A1 | 5/2003 | Sahara | 399/103 |
| 2003/0142994 | A1 | 7/2003 | Harada et al. | 399/111 |
| 2003/0156855 | A1 | 8/2003 | Nittani et al. | 399/106 |

FOREIGN PATENT DOCUMENTS

| | | | |
|---|---|---|---|
| JP | 7-50760 | | 11/1995 |
| JP | 2002201461 A | * | 7/2002 |
| JP | 2003-56709 | | 2/2003 |
| JP | 2003-140465 A | | 5/2003 |
| JP | 2003-223047 A | | 8/2003 |

* cited by examiner

*Primary Examiner*—Robert Beatty
(74) *Attorney, Agent, or Firm*—Fitzpatrick, Cella, Harper & Scinto

(57) ABSTRACT

A seal member for sealing the developer container at a boundary between the developer container and a developer carrying member is disposed at an opening of a developer container containing developer. The sealing member includes a warp pile fabric, and is formed by a V pile weave providing a V-shaped pile fabric texture. The seal member has a fiber density, representing a number of fibers per unit area, of not less than 260,000/inch$^2$ and not more than 680,000/inch$^2$ and has a number of denier per one pile of not less than 200 denier and not more than 350 denier.

6 Claims, 18 Drawing Sheets

SEAL MEMBER, DEVELOPING APPARATUS, PROCESS CARTRIDGE AND IMAGE FORMING APPARATUS

FIELD OF THE INVENTION AND RELATED ART

The present invention relates to a seal member for effectively preventing leakage of developer, a developing apparatus including the seal member, a process cartridge including the developing apparatus, and an image forming apparatus.

Herein, an image forming apparatus refers to an apparatus in which an image is formed on a recording medium in an electrophotographic image forming scheme or an electrostatic recording scheme. Examples of the image forming apparatus may include an electrophotographic copying machine, an electrophotographic printer (such as laser beam printer or an LED printer), a facsimile apparatus, and a word processor.

A process cartridge is a cartridge in which at least a developing means (developing apparatus) as an image forming means (a processing means) and an electrophotographic photosensitive member (photosensitive drum) as an image bearing member are integrally disposed to make them removably mountable in a main assembly of an image forming apparatus as a cartridge.

In the electrophotographic image forming apparatus, an image bearing member electrically charged uniformly by a charging means is subjected to selective exposure to light, whereby an electrostatic latent image is formed on the surface of the image bearing member. The electrostatic latent image is developed into a visual image as a developer image (toner image) with developer (toner) supplied from a developing means (developing apparatus). Thereafter, the developer image is transferred onto a recording medium. Then, the developer image is fixed on the recording medium under the application of heat or pressure, whereby image recording on the recording medium is performed. Further, developer remaining on the image bearing member after the transfer is removed by a cleaning means such as a cleaning blade, thus being recovered in a cleaning container as residual developer (removal toner). As a result, a subsequent developing operation can be performed in such a state that developer does not remain on the surface of the image bearing member.

Of these processing means for image formation, the image bearing member, the charging means, the developing means, the cleaning means, etc., are integrally disposed to provide a cartridge which is detachably mountable to the main assembly of the image forming apparatus. Such a cartridge has been put into practical use as a process cartridge. According to a scheme using the process cartridge, a user can effect replacement of the cartridge by him/her self. In other words, the user can effect replacement of consumable parts, such as the image bearing member, developer and so on, without maintenance by service personnel.

In such a process cartridge, as a part thereof, a frame member constituting a developer container containing developer (toner) provided with an opening at an end thereof, is disposed. A developing roller as a developer carrying member, which is disposed rotatably to the opening, for conveying the toner to the image bearing member is also disposed. Further, a developing blade as a developer regulation member for regulating an amount of toner carried on the developing roller is disposed. Thus, the developing means, i.e., the developing apparatus is constituted. The opening of the frame member is opposed to the image bearing member. At both ends of the opening, an end portion seal member for preventing toner leakage in a longitudinal direction of the developing roller is disposed. Further, at one end of the opening, a flexible seat member is provided for preventing leakage of toner from a spacing between the opening and the end portion seal member.

As the end portion seal member, a seal member formed of, e.g., an electrostatic flocking member or felt has been conventionally used. Particularly, in recent years, a seal member including a pile fabric has been used as the end portion seal member with a reduction in particle size of developer. The pile fabric includes a fabric base comprising warp and weft, and piles raised from the fabric base. The piles contact the developing roller as a seal portion to prevent leakage of toner.

In the conventional pile seal member, e.g., the fabric base is constituted by a layer of warp and weft, and a pitch of piles is determined by a pitch of weft constituting the fabric base.

More specifically, FIG. 4 shows a structure of a conventional pile seal member having a single layer of fabric base. After warps 25*a* to 25*d*, wefts 26, and piles 27 are woven, the resultant fabric is cut by a cutter 29 along a cutting line 28, whereby two sheets of fine fabric 200 are prepared.

In a weave (woven) structure of this pile seal member, the piles 27 are place in a woven state with respect to the single fabric base 200. In FIG. 4, only one pile is shown for convenience of explanation of the weave structure but a plurality of piles 27 are actually woven into the pile fabric on the basis of the pitch of wefts 26. Accordingly, the pitch of the piles 27 is determined by the pitch of the wefts 26.

As described above, formation of the pile seal member as the end portion seal member has been known (Japanese Utility Model Publication No. Hei 07-50760). Further, the use of a porous hollow fiber as a fiber for piles has also been known (Japanese Laid-Open Patent Application No. 2003-56709).

SUMMARY OF THE INVENTION

An object of the present invention is to provide a seal member, used in, e.g., an end portion seal means of a developing apparatus, which is further improved in sealing performance.

Another object of the present invention is to provide a seal member which maintains a stable sealing performance without lowering the degree of denseness of piles.

A further object of the present invention to provide a seal member which is less liable to cause damage of a developer carrying member, such as abrasion or wearing thereof.

A still further object of the present invention to provide a developing apparatus, a process cartridge, and an image forming apparatus which employ the above described seal member.

According to the present invention, there is provided a seal member, disposed at an opening of a developer container containing developer, for sealing the developer container at a boundary between the developer container and a developer carrying member, the sealing member including a warp pile fabric, wherein the sealing member is formed by a V pile weave providing a V-shaped pile fabric texture and has a fiber density, representing a number of fibers per unit area, of not less than 260,000/inch$^2$ and not more than 680,000/inch$^2$ and a number of denier per one pile of not less than 200 denier (D) (about 222 decitex (Dtex) and not more than 350 D (about 389 Dtex).

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of a seal member, a developing apparatus, a process cartridge, and an image forming apparatus according to the present invention will be described with reference to the drawings.

The present invention relates to a seal member used as an end portion seal (means) for preventing scattering of toner from a side of a developing apparatus. The seal member is disposed in a developing apparatus, a process cartridge and an image forming apparatus.

An image forming apparatus according to an embodiment of the present invention will be described with reference to FIG. 3.

Figure 3:
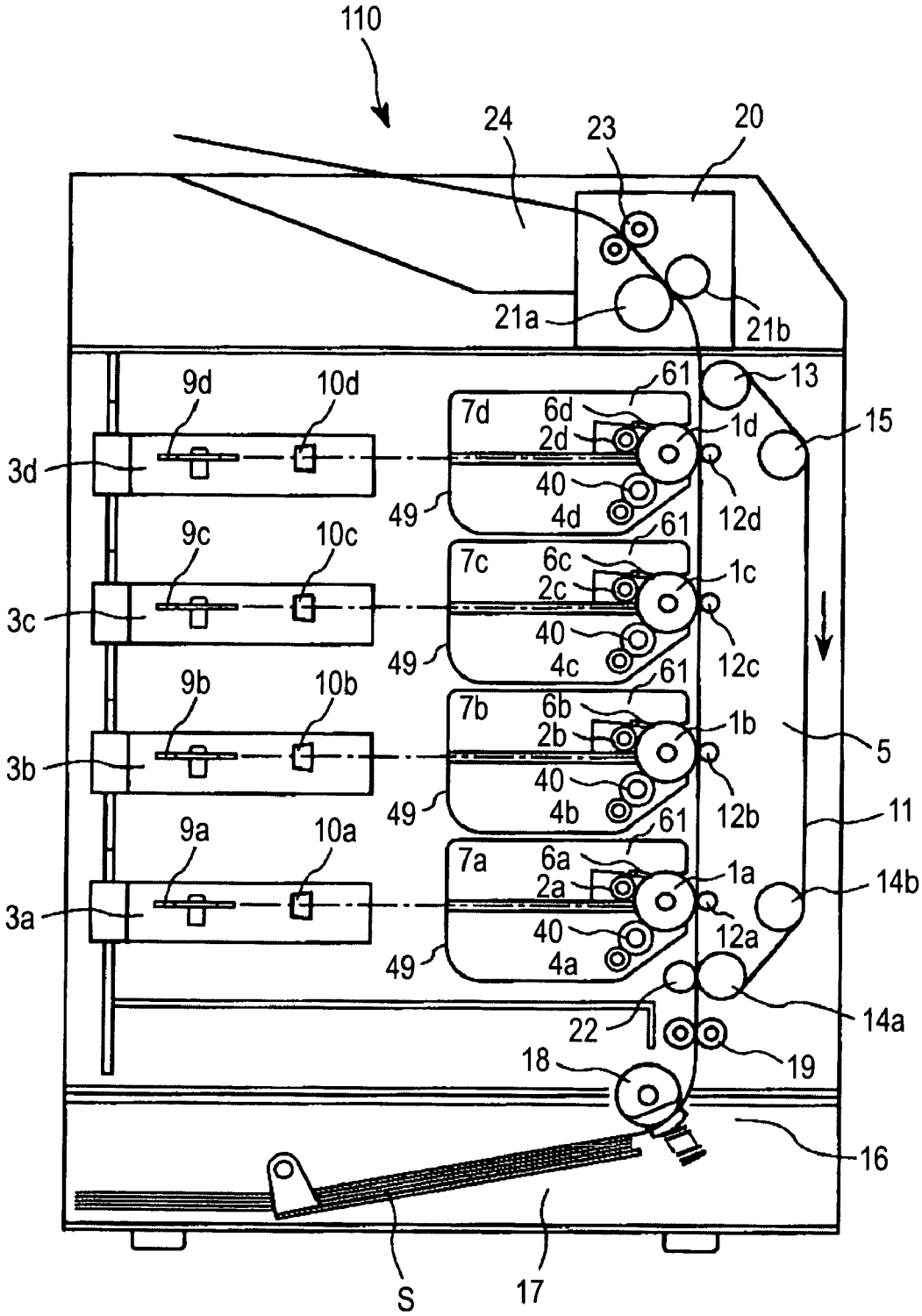
FIG. 3 is a schematic sectional view showing an image forming apparatus according to an embodiment of the present invention.
Figure 4:
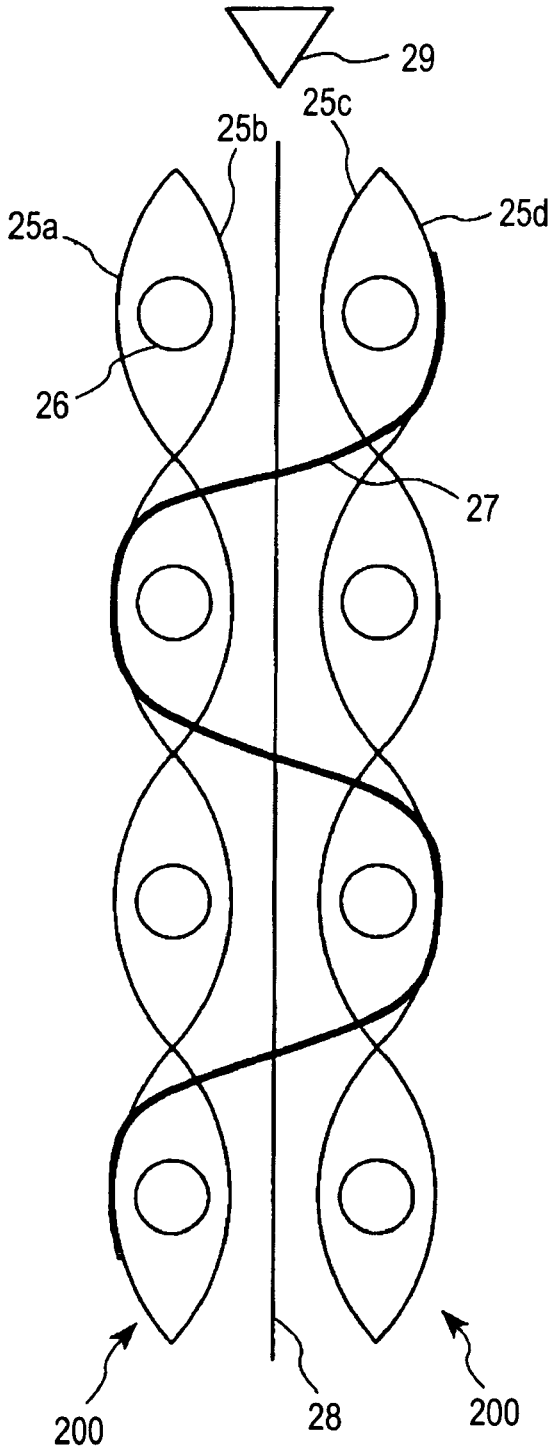
FIG. 4 is a sectional view showing an embodiment of a conventional warp pile fabric.

FIG. 3 shows a structure of the image forming apparatus using a process cartridge (7*a*, 7*b*, 7*c*, 7*d*). This structure is merely an example, and the present invention is applicable to image forming apparatus having any structures so long as they include a developing apparatus 4.

First, referring to FIG. 3, the general structure of the image forming apparatus according to the present invention will be described. FIG. 3 is a vertical sectional view of a full-color laser beam printer 110, that is, an embodiment of a multi-color image forming apparatus, for showing the general structure thereof.

The multi-color image forming apparatus 110 shown in FIG. 3 comprises four photosensitive drums (1*a*, 1*b*, 1*c*, 1*d*) which are vertically stacked in parallel. Each of the photosensitive drums as an image forming member is rotationally driven by a driving means (not shown) in the counterclockwise direction in the figure. Around the peripheral surface of each of the photosensitive drums, process means are disposed. In a rotation direction of each of the photosensitive drums, the process means are disposed in the following order. First, a charging apparatus (2*a*, 2*b*, 2*c*, 2*d*) as a charging means for electrically charging uniformly the surface of an associated photosensitive drum (1*a*, 1*b*, 1*c*, 1*d*) is disposed. A scanner unit (3*a*, 3*b*, 3*c*, 3*d*) as an exposure means (latent image forming means) for forming an electrostatic latent image on the photosensitive drum with a laser beam on the basis of image information, is disposed. Next, a developing apparatus (4*a*, 4*b*, 4*c*, 4*d*) as a developing means is disposed in order to develop the electrostatic latent image with toner by adhering toner particles to the electrostatic latent image. Next, a primary transfer roller (12*a*, 12*b*, 12*c*, 12*d*) as a transfer means (an electrostatic transfer apparatus) for transferring a developer (toner) image formed on the photosensitive drum onto a recording medium S, is disposed. Next, a cleaning apparatus (6*a*, 6*b*, 6*c*, 6*d*) for removing a transfer residual toner remaining on the surface of the photosensitive drum after the transfer, is disposed.

In this embodiment, the photosensitive drum, the charging apparatus, the developing apparatus, and the cleaning apparatus are integrally disposed in a process cartridge (7*a*, 7*b*, 7*c*, 7*d*).

The respective structural members of the image forming apparatus 110 will be described in detail.

The photosensitive drum comprises an aluminum cylinder and a layer of organic photoconductor (OPC) coated on the peripheral surface of the aluminum cylinder, i.e., an OPC photosensitive member. The photosensitive drum is rotatably supported by a supporting member at longitudinal end portions thereof. To one of the longitudinal end portions of the photosensitive drum, a driving force is transmitted from a driving motor (not shown), whereby the photosensitive drum is rotationally driven in the counterclockwise direction of FIG. 3.

The charging apparatus may be of a type which employs a contact charging method. The charging apparatus is an electrically conductive roller formed in a roller shape and is placed in contact with the surface of the photosensitive drum. The surface of the photosensitive drum is uniformly charged by applying a charging bias voltage to the roller.

The scanner unit is disposed in a direction substantially perpendicular to a line connecting centers of the photosensitive drums 1*a*, 1*b*, 1*c* and 1*d*, i.e., a horizontal direction substantially in parallel with an apparatus mounting surface in the figure. A polygon mirror (9*a*, 9*b*, 9*c*, 9*d*) rotated at high speed by a scanner motor (not shown) is irradiated with light comprising an image (information), corresponding to image (information) signals, emitted from a laser diode (not shown). The charged surface of the photosensitive drum (1*a*, 1*b*, 1*c*, 1*d*) is selectively exposed to the image light reflected by the polygon mirror through a focusing lens (10*a*, 10*b*, 10*c*, 10*d*), whereby an electrostatic latent image is formed on the photosensitive drum.

The developing apparatuses 4*a*, 4*b*, 4*c* and 4*d* have developer containers 49 containing yellow, magenta, cyan, and black toners, respectively. The order of arrangement of these developing apparatuses may be appropriately changed.

An electrostatic transfer apparatus 5 is provided with an electrostatic transfer belt which is disposed opposite to all the photosensitive drum 1*a*, 1*b*, 1*c* and 1*d* and moved circularly in contact with the photosensitive drums. The transfer belt 11 comprises a film-like member and is vertically supported by four rollers 13, 14*a*, 14*b* and 15. The transfer belt 11 electrostatically adsorbs a recording medium S at its outer peripheral surface on the left-hand side thereof in the figure, and is moved circularly so that the recording medium S contacts the photosensitive drum (1*a*, 1*b*, 1*c*, 1*d*). By doing so, the recording medium S is conveyed to a transfer position by the transfer belt 11. At the transfer position, the toner image on the photosensitive drum (1*a*, 1*b*, 1*c*, 1*d*) is transferred onto the recording medium S.

Inside the transfer belt 11, transfer rollers (12*a*, 12*b*, 12*c*, 12*d*) are disposed at a position at which they oppose the corresponding photosensitive drums (1*a*, 1*b*, 1*c*, 1*d*) which contacts the transfer belt 11. As positive electric charge is applied to the recording medium S through the transfer belt 11, the toner image on the photosensitive drum, which is negative in polarity, is transferred by the electric field generated by the positive electric charge, onto the recording medium S in contact with the photosensitive drum.

The transfer belt 11 is wound about the four rollers including a driver roller 13, two follower rollers 14*a* and 14*b*, and a tension roller 15, and is rotationally driven in a direction of an indicated arrow in FIG. 3. As a result, the transfer belt 11 is circularly moved. The toner image is transferred onto the recording medium S during conveyance of the recording medium S from the follower roller 14*a* side to the driver roller 13 side.

A conveying portion 16 is a portion for conveying the recording medium S to the image forming portion, and includes a cassette 17 which holds a plurality of recording media S. During an image forming operation, a conveying roller 18 and a registration roller pair 19 are rotationally driven in synchronism with the image forming operation, whereby the plurality of recording media S in the cassette 17 are sequentially conveyed one by one. The leading edge of each recording medium S comes into contact with the registration roller pair 19 and is temporarily stopped. Then, the recording medium S is conveyed to the transfer belt 11 by the registration roller pair 19 in synchronism with timing of image formation.

A fixing portion 20 is for fixing a plurality of unfixed toner images, different in color, transferred onto the recording medium S, to the recording medium S. The fixing portion 20 comprises a rotational heat roller 21*a* and a pressure roller 21*b* kept pressed upon the heat roller 21*a* to apply heat and pressure to the recording medium S. More specifically, while the recording medium S, onto which the plurality of toner images different in color have been transferred from the respective photosensitive drums, one for one, is conveyed through the fixing portion 20, by the fixing roller pair 21, heat and pressure are applied by the fixing roller pair 21. As a result, the plurality of different color toner images are fixed to the surface of the recording medium S.

In the image forming operation, the process cartridges (7*a*, 7*b*, 7*c*, 7*d*) are sequentially driven in synchronism with the recording (image formation) timing. As they are driven, the photosensitive drums (1*a*, 1*b*, 1*c*, 1*d*) are rotationally driven in the counterclockwise direction, and the scanner units (3*a*, 3*b*, 3*c*, 3*d*) opposing the respective process cartridges (7*a*, 7*b*, 7*c*, 7*d*) one for one are sequentially driven. By the rotational drive of the process cartridges, the charge roller uniformly charges the peripheral surface of the corresponding photosensitive drum, and the uniformly charged peripheral surface of the photosensitive drum is exposed to the light projected by the scanner unit while being modulated with image (information) signals. As a result, an electrostatic latent image is formed on the peripheral surface of the photosensitive drum. The developing roller 40 in the developing apparatus 4 transfers the toner onto a lower potential portion of the electrostatic latent image to form a developer image (toner image) on the peripheral surface of the photosensitive drum, i.e., develop the electrostatic latent image on the photosensitive drum.

Then, the leading edge of the toner image on the peripheral surface of the most upstream photosensitive drum is conveyed to an opposing line (position) where the most upstream photosensitive drum and the transfer belt 11 are opposed to each other. The rotation of the registration roller pair 19 is started to release the recording medium S onto the transfer belt 11 so that the arrival of the leading edge of the recording medium S at the opposing line synchronizes with the arrival of the recording starting line of the recording medium S at the opposing line, whereby the recording medium S is conveyed to the transfer belt 11.

The recording medium S is sandwiched between the electrostatic adsorption roller 22 and the transfer belt 11 and is pressed onto the outer peripheral surface of the transfer belt 11, and a voltage is applied between the transfer belt 11 and the electrostatic adsorption roller 22. By doing so, an electric charge is induced in the recording medium S as a dielectric material and a dielectric layer of the transfer belt 11, whereby the recording medium S is electrostatically adsorbed by the transfer belt 11 at its outer peripheral surface. As a result, the recording medium S is stably adsorbed by the transfer belt 11 and conveyed to the most downstream transfer portion.

As described above, while the recording medium S is conveyed, the respective color toner images on the corresponding photosensitive drums are sequentially transferred onto the recording medium S by the electric fields generated between the respective photosensitive drums and the corresponding transfer rollers 12.

After the transfer of the four color toner images onto the recording medium S, the recording medium S is separated from the transfer belt 11 with utilization of the curvature of the belt driving roller 13, and is conveyed into the fixing portion 20. In the fixing portion 20, the toner images are thermally fixed to the recording medium S. Thereafter, the recording medium S is discharged from the apparatus main assembly through an outlet portion 24 by a discharge roller pair 23.

Meanwhile, the photosensitive drum after the transfer of the toner image onto the recording medium S is cleaned by the cleaning apparatus, whereby the residual developer is recovered from the peripheral surface of the photosensitive drum before the charging step is performed again. The residual developer is recovered into a cleaning container 61.

As described above, the structure of the image forming apparatus usable in the present invention is not limited to that of the above-described image forming apparatus. For example, it is possible to use a single photosensitive drum or a rotary developing apparatus in which developing apparatuses are mounted to a rotational member. It is also possible to employ an intermediary transfer member onto which a toner image is temporarily transferred from the photosensitive drum.

Further, the structure of the process cartridge is also not restricted to that of the process cartridge described above so long as it includes the photosensitive drum and the developing apparatus 4. The process cartridge may be omitted from in the image forming apparatus.

Further, the developing apparatus may be modified into a developing unit so that only the developing apparatus is detachable from the process cartridge.

Next, the weave structure of the warp pile fabric, used as the end portion seal (member) 100, according to an embodiment of the present invention will be described with reference to FIG. 1.

Figure 1:
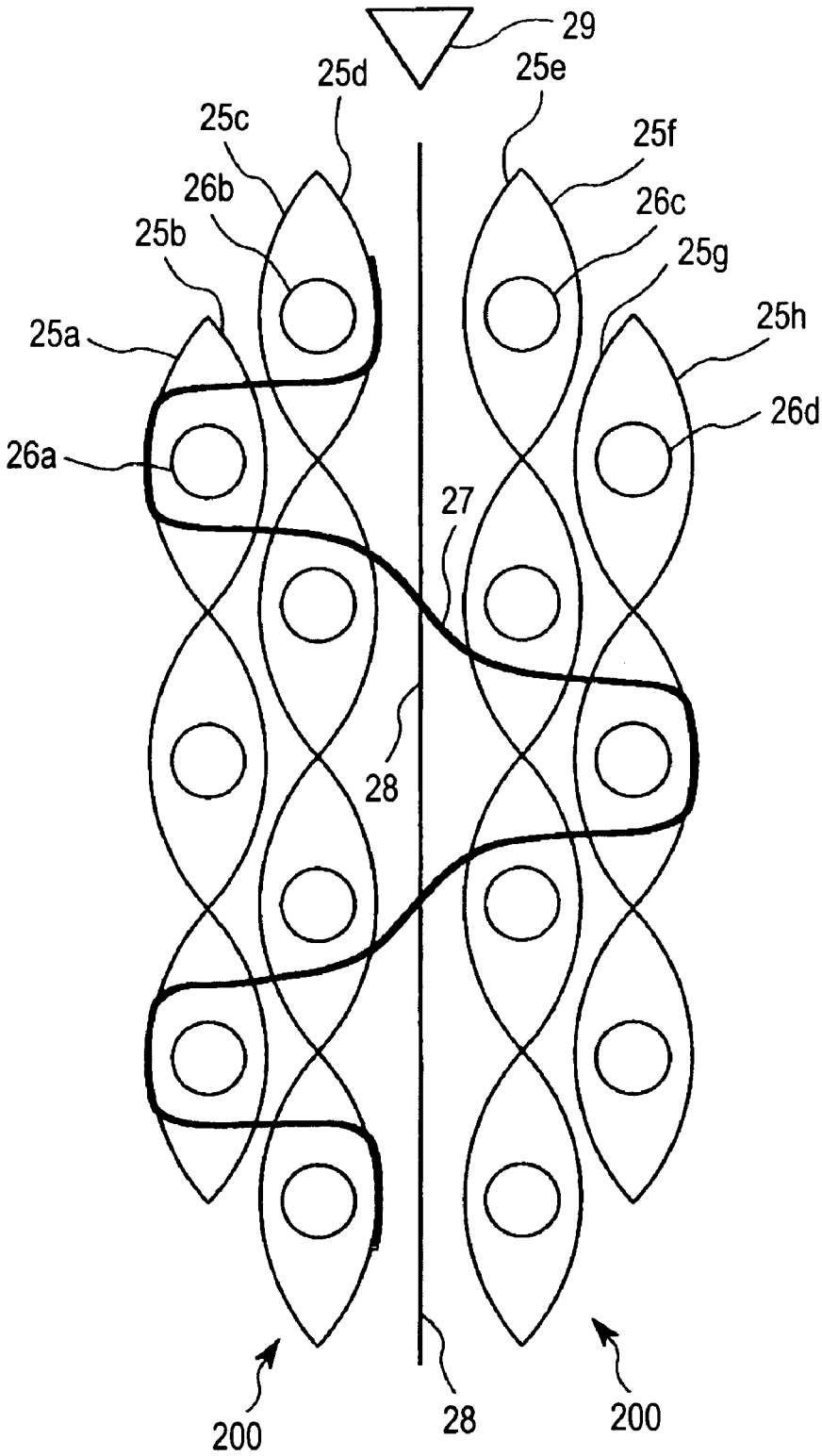
FIG. 1 is a sectional schematic view showing a warp pile fabric according to an embodiment of the present invention.

As shown in FIG. 1, a warp pile fabric 200 as a material for the seal member of this embodiment is prepared by weaving warp 25*a* to 25*h*, weft 26*a* to 26*d*, and piles 27 and then cutting a resultant woven pile fabric along a cutting line 28 by a cutter 29. As a result, two sheets of warp pile fabric 200 are prepared. The warp pile fabric 200 is constituted by two layers including four warps (25*a* to 25*d*, or 25*e* to 25*h*) and two wefts 26 (26*a* and 26*b*, or 26*c* and 26*d*). The piles 27 are woven into the two layers. In FIG. 1, only one pile 27 is shown for convenience of simple explanation of the weave structure but a plurality of piles 27 are actually woven into the pile fabric on the basis of the pitch of the wefts 26. In this embodiments, the fineness of one pile 27 is set to 330 denier (D). Further, in this embodiment, the pile density is 1680 piles/inch$^2$ and the fiber density is 672,000 fibers/inch$^2$.

The number of denier per one pile, the pile density, and the fiber density can be adjusted in the following manner.

First, in the present invention short fibers are spun into a single yarn, and a plurality of yarns are twisted to provide a single pile (one pile). By controlling an amount of the short fibers at the time of spinning the short fibers, it is possible to adjust the number of denier (per one pile) of a first prepared single pile. Further, it is possible to finally adjust the number of denier per one pile of the resultant piles depending on the number of yarns to be twisted. When the thus prepared piles are set to a weaving machine, a density of the piles to be set to the weaving machine is controlled to adjust a resultant pile density. The fiber density referred to herein is a value representing the amount of the short fibers per unit area. Accordingly, the fiber density is determined by conditions of the spinning and twisting with respect to the piles and a degree of pile density at the time of weaving the piles.

A process of producing a seal member using the warp pile fabric in this embodiment will be described in the order of production steps.

Referring to FIG. 1, in order to further increase the density of the piles 27 compared with the case of conventional piles, the fabric base 200 is constituted by the two layers comprising warps 25*a* to 25*d* (or 25*e* to 25*h*) and wefts 26.

A basic texture of the two-layer weave structure will be described more specifically with reference to FIG. 5.

The fabric base 200 is constituted by the two layers comprising four warps 25*a* to 25*d* (or 25*e* to 25*h*) and two wefts 26*a* and 26*b* (or 26*c* and 26*d*). The piles 27 are respectively woven into the two layers. In FIG. 5, only one pile 27 is shown for convenience of explanation of the weave structure but a plurality of piles 27 are actually woven at a pitch on the basis of the pitch of the wefts 26.

Figure 5:
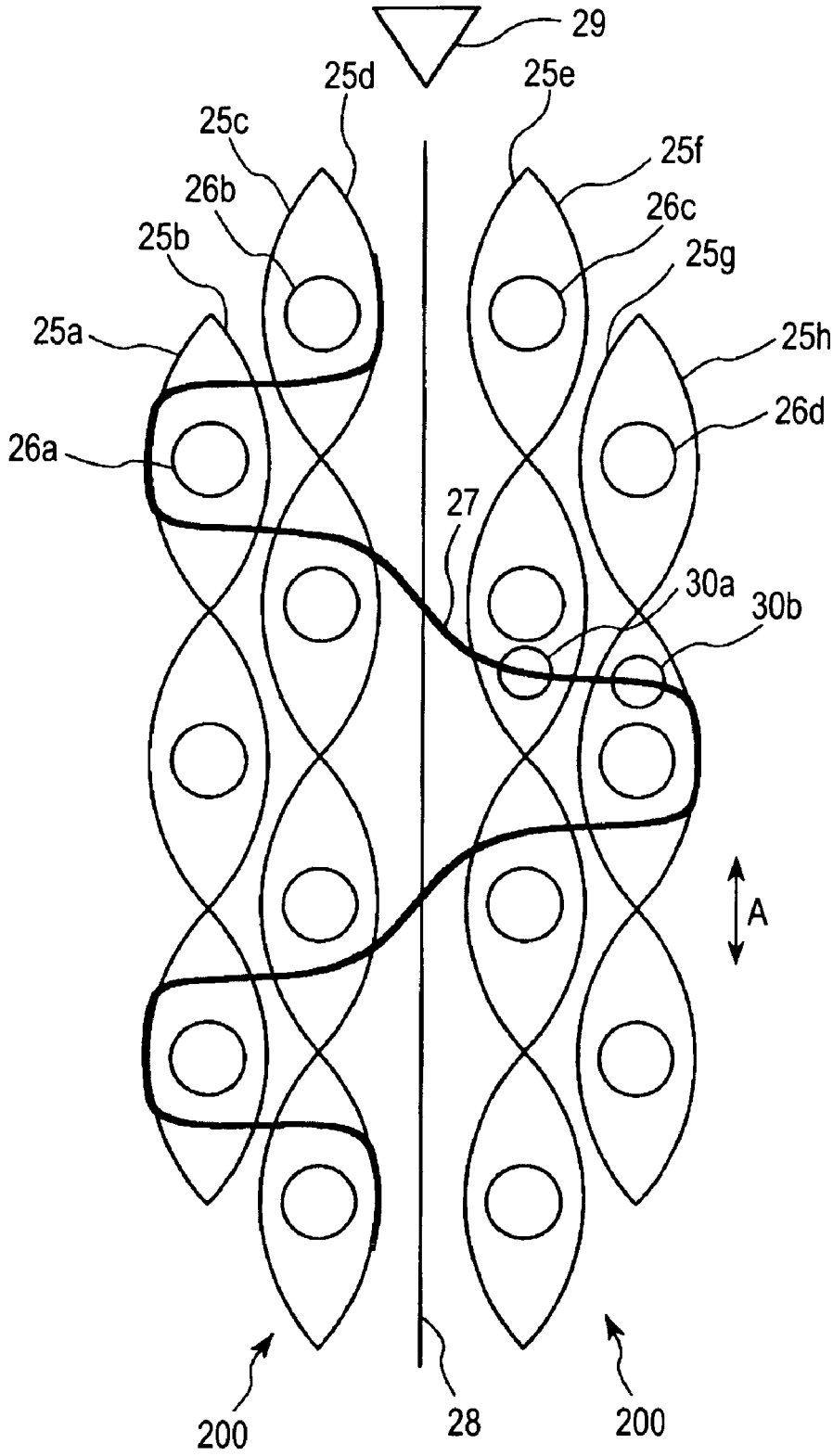
FIG. 5 is a sectional view showing an embodiment of a warp pile fabric including piles having a V pile weave structure.

As shown in FIG. 5, the warp pile fabric 200 comprises the fabric base 200 having two layers. The warps 25*a* to 25*d* (or 25*e* to 25*h*) constitute the two layers consisting of an upper layer and a lower layer in which a fabric pattern is shifted from that in the upper layer by one-half the pitch of the wefts 26. As described above, the warps 25*a* to 25*h*, the wefts 26*a* to 26*d*, and the piles 27 are woven into a single pile fabric, and thereafter the pile fabric is cut along the cutting line 28 by the cutter to provide two sheets of the warp pile fabric 200.

In this embodiment, the piles 27 are woven in a V shape. In other words, the warp pile fabric is prepared through a V pile weave in which a fabric texture of the piles has a V shape.

Figure 6:
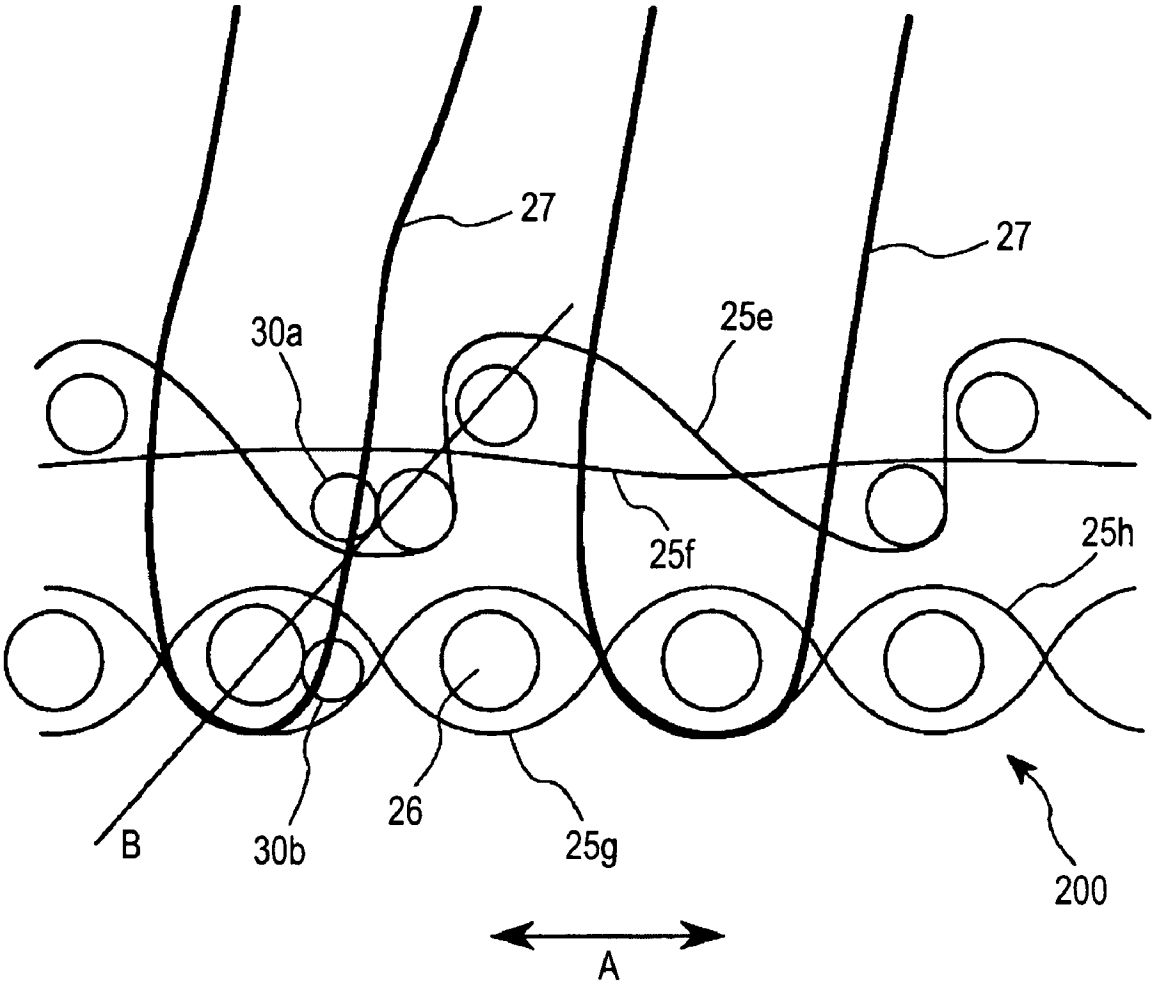
FIG. 6 is an explanatory view showing an embodiment of a warp pile fabric including piles having a V pile weave structure.

An actual weave structure of the seal member 100 using the warp pile fabric 200 have the two layer weave structure will be described with reference to FIG. 6.

The warps and the wefts 26 of the seal member 100 constitute the two layers. As shown in FIG. 6, an arrangement of the wefts 26 is such that a part of wefts 26 is substantially aligned with a line B. In this state, a tension of the warp is set so that the tension exerted on the warps 25*e* and 25*f* located on the developing roller 40 side is smaller than the tension exerted on the warps 25*g* and 25*h*, whereby a stretching force in a planar (surface) direction indicated by an arrow A becomes weaker. As a result, the pile 27 does not become thinner at a connecting portion 30*a* thereof by tightening, as shown in FIGS. 5 and 6. Further, by increasing the tension exerted on the warps 25*g* and 25*h*, the stretching force in the arrow A direction becomes stronger, so that the piles 27 and the fabric base 200 are strongly tangled with each other at a connecting portion 30*b*, thus being less liable to be unraveled.

An example of dimensions with respect to the warps, the wefts 26, and the piles will be described below.

The warp is two folded (ply) yarn which comprises polyester and rayon and has a fineness of 177 denier (D)(No. 30 count cotton yarn), and the weft 26 is a single yarn which comprises polyester and has a fineness of 333 D (No. 15 count cotton yarn).

One pile comprises two species of acrylic fibers having finenesses of 3 D and 1.5 D and a rayon having a fineness of 1.5 D. These fibers are pun into two folded yarn (529 D) including a single yarn (265 D). The two folded yarn and electroconductive fibers having a fineness of 20 D/fiber are twisted to provide a single pile (one pile) 27.

Figure 7:
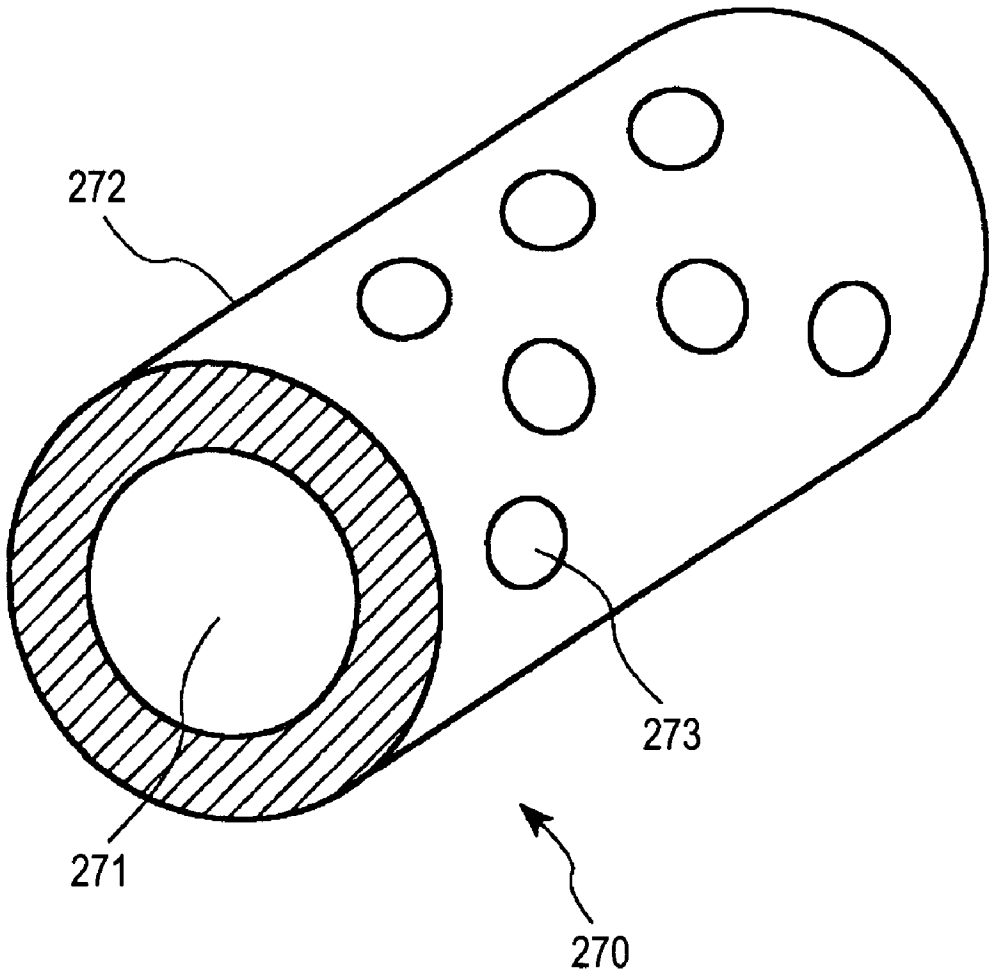
FIG. 7 is a perspective view showing an embodiment of a porous fiber constituting a pile.

The acrylic fibers constituting the pile 27 are not an ordinary acrylic fiber but a porous hollow fiber, which will be described with reference to FIG. 7. FIG. 7 is an enlarged view of a porous hollow fiber 270. The fiber 270 has a central hollow portion 271 and an outer surface 272 which is provided with a large number of holes 273 communicating with the central hollow portion 271. In the warp pile fabric 200, when the density of the piles 27 is increased in order to improve the sealing performance as the particle size of toner is decreased, the piles 27 becomes dense and decrease in flexibility. For this reason, there are possibilities that the developing roller 40 is damaged such that the surface thereof is worn or abraded, and that the running torque of the developing roller 40 is increased. In order to solve these problems, the fiber 270 is formed as a porous hollow fiber, whereby the firmness of the fibers 270 per one fiber is decreased to minimize the possibility of occurrence of the damage or increase in torque.

In this embodiment, rayon which is not porous is used in spinning for preparing the piles 27. This is because the firmness of the piles 27 is excessively lowered when only the hollow fibers are used, so that the firmness is controlled by adding the non-porous rayon fiber during the spinning.

The warp pile fabric woven in the two-layer structure is, after being woven, processed until it is finished as the seal member. Such processing steps are shown in a flow chart of FIG. 8.

Figure 8:
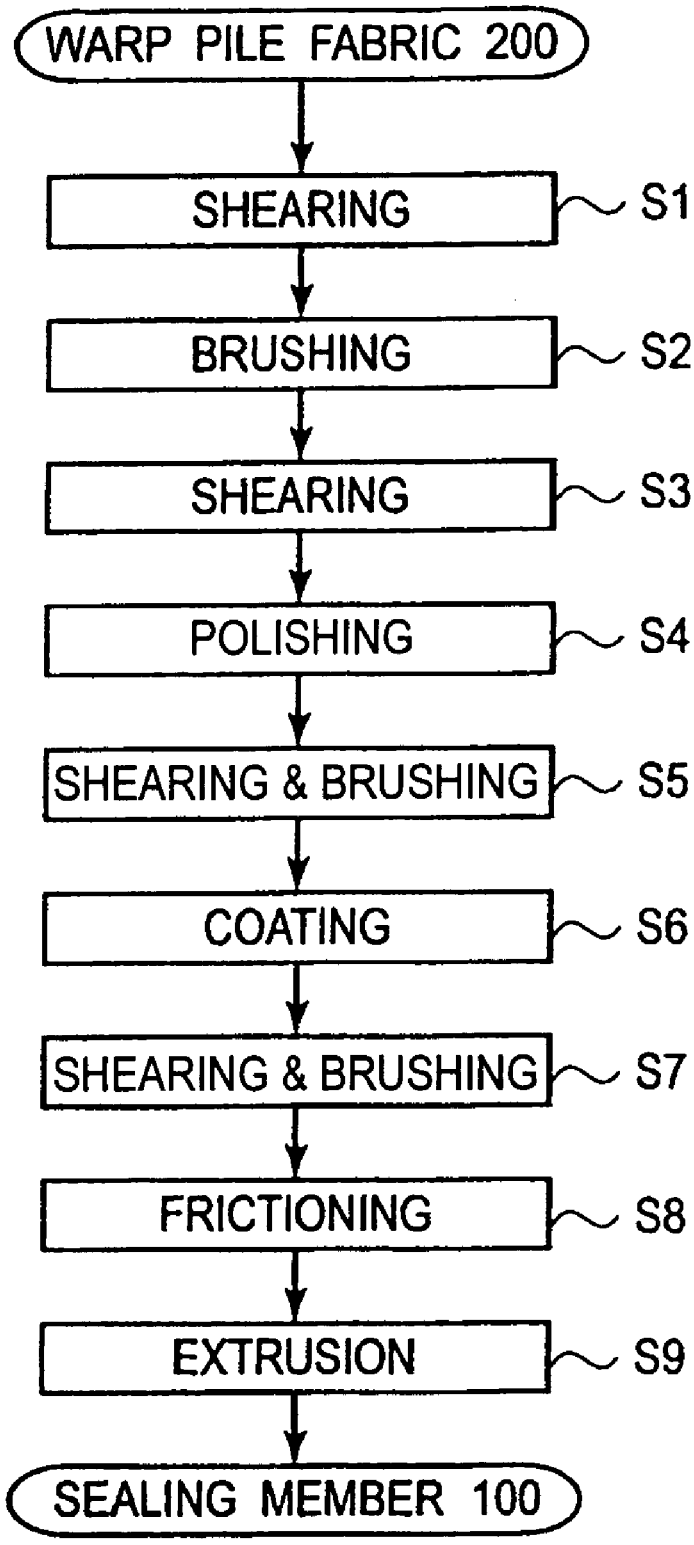
FIG. 8 is a flow chart showing processing steps of warp pile fabric.
Figure 9:
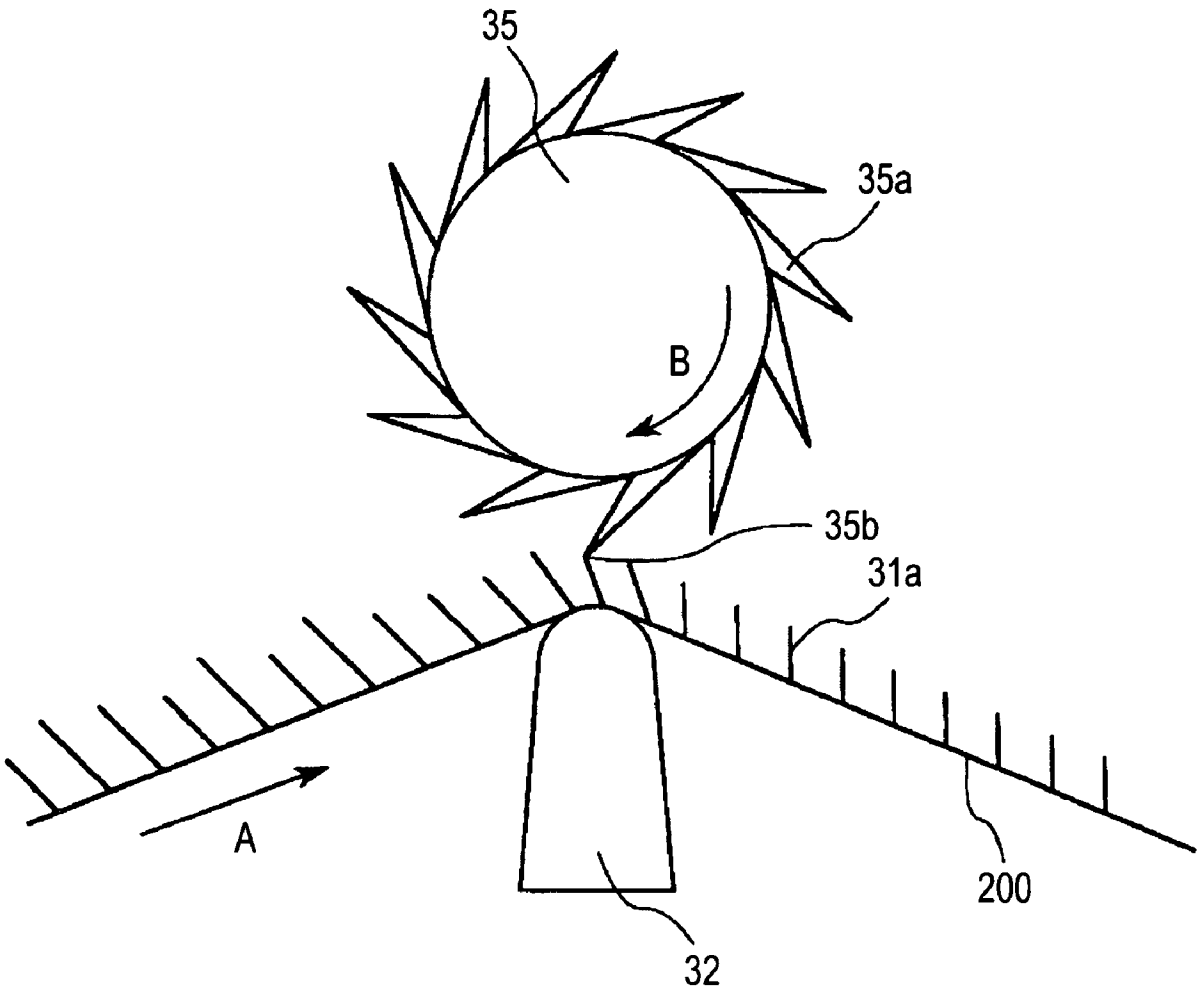
FIG. 9 is an explanatory view for illustrating an operation in a shearing step.

Referring to FIG. 8, in a step S1, first of all, the warp pile fabric 200 is subjected to shearing, which is a process for uniformizing the pile length after it is woven. This shearing step will be described more specifically with reference to FIG. 9. In FIG. 9, the warp pile fabric 200 is fed in a direction of an arrow A while being pressed against a shearing roller 35, having a rotary cutting edge 35*a* at its surface, by a wedge 32. At that time, the shearing roller 35 is rotated in a direction of an arrow B opposite from the warp pile fabric feeding direction of the arrow A, whereby piles 31*a* are cut by the rotary cutting edge 35*a* at a contact portion 35*b* therebetween. As a result, the pile length is uniformized. The piles 27 have an ununiform pile length in a state that they are only cut in the weaving step. For this reason, the uniform pile length is ensured by performing the shearing step.

Figure 10:
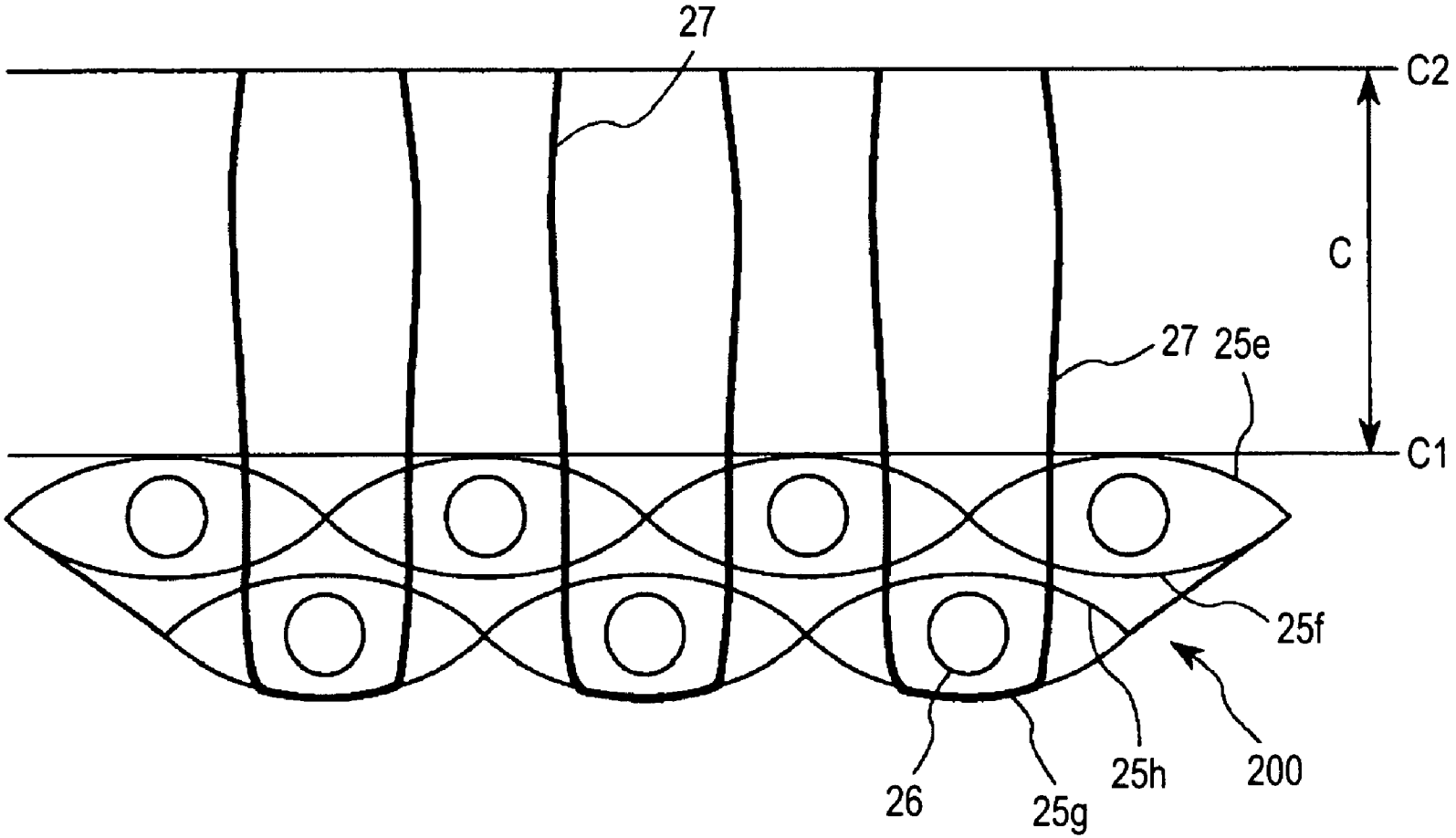
FIG. 10 is an explanatory view for illustrating a length of pile.

Herein, the pile length, as show in FIG. 10, represents a linear dimension C from an upper surface portion C1 of fabric base to a top portion C2 of the piles 27.

Figure 11:
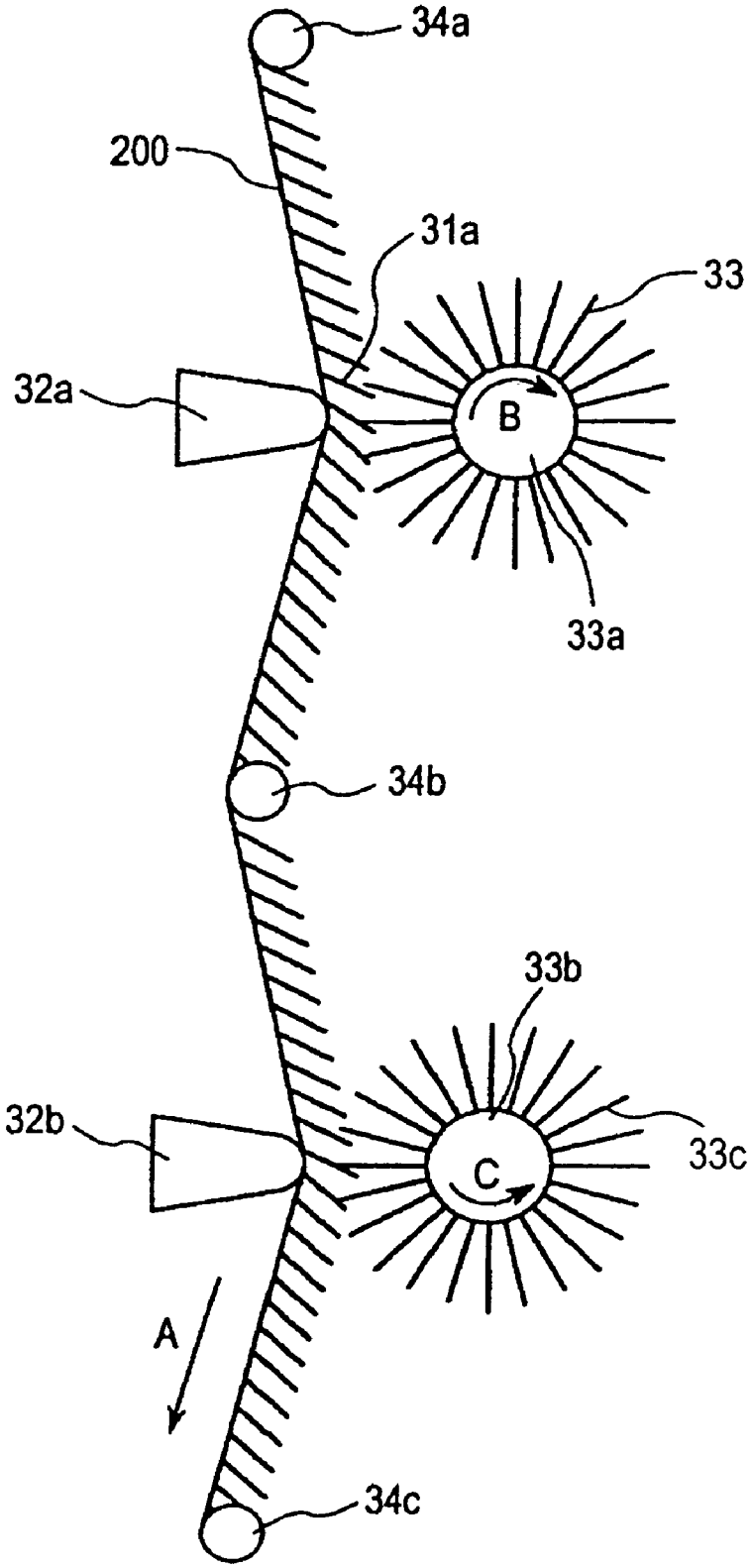
FIG. 11 is an explanatory view for illustrating an operation in a brushing step.

After the shearing step (step S1), in a step S2, the warp pile fabric 200 is subjected to a brushing step for unraveling the piles 27. The brushing step will be described more specifically with reference to FIG. 11. In FIG. 11, the warp pile fabric 200 is extended along holding rollers 34*a*, 34*b* and 34*c*. In this state, the warp pile fabric 200 is fed in a direction of an arrow A. First, the warp pile fabric 200 is pressed against a brushing roller 33*a* by a wedge 32*a*. At the surface of the brushing roller 33*a*, a large number of needle-like members 33 are provided. The brushing roller 33*a* is rotated in a direction of an arrow B opposite from the arrow A direction, i.e., the feeding direction of the warp pile fabric 200. By controlling the amount of movement of the wedge 32*a*, the entering amount of the needle-like members 33 provided to the brushing roller 33*a* is adjusted. By doing so, the condition of the brushing is controlled. As a result, piles 31*a* of the warp pile fabric 200 are unraveled.

Figure 12:
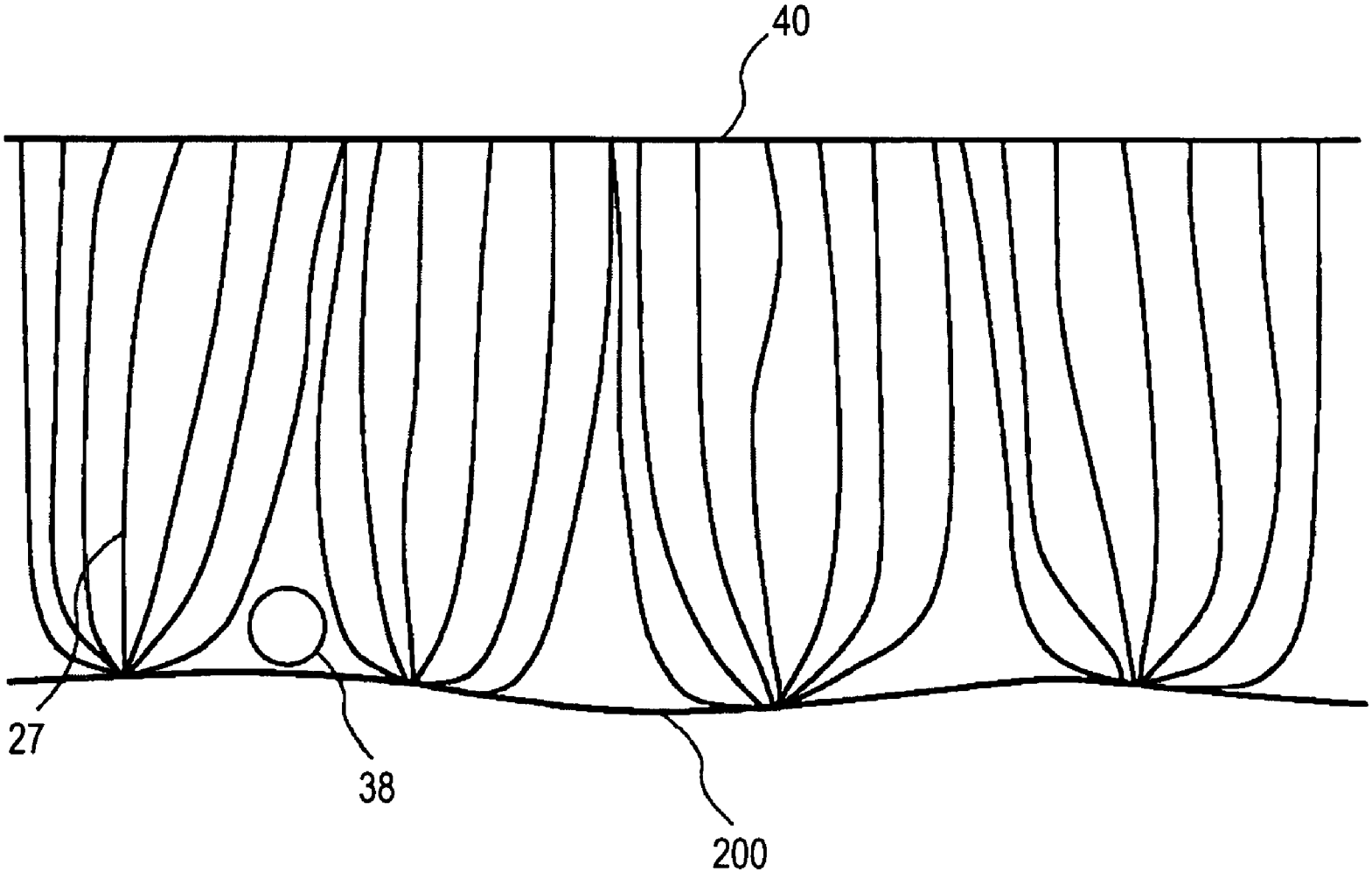
FIG. 12 is an explanatory view for illustrating a state of piles in the brushing step.

This is further described in detail with reference to FIG. 12. A root portion of the piles 27 changes the tensions of the warps 25 in the two layers, respectively, in the above described weaving step, whereby the root portion is not tightened by the fabric base 200. Further, the piles 27 are placed, in the brushing step, in such a state that they are sufficiently unraveled or disentangled from the root portion, thus providing a spacing 38 between adjacent root portions. For this reason, the piles 27 are bent when the developing roller 40 is mounted, thus entering the spacing 38. As a result, leakage of toner from the spacing is effectively suppressed.

In this state in the brushing step, the roller 33*a* is rotated in the opposite direction of the arrow B as described above, so that a direction of the unraveled piles is not stabilized. Accordingly, as shown in FIG. 11, the piles 31*a* of the warp pile fabric 200 are pressed against a brushing roller 33*b* by a wedge 32*b*. In this state, the brushing roller 33*b* is rotated in a direction identical to the feeding direction (of the arrow A) of the warp pile fabric 200, whereby the direction of the piles 31*a* is uniformized by needle-like members 33*c* provided to the brushing roller 33*b*. Further, the piles 31*a* (27) are placed in a state that they are obliquely raised from the fabric base 200.

Figure 13:
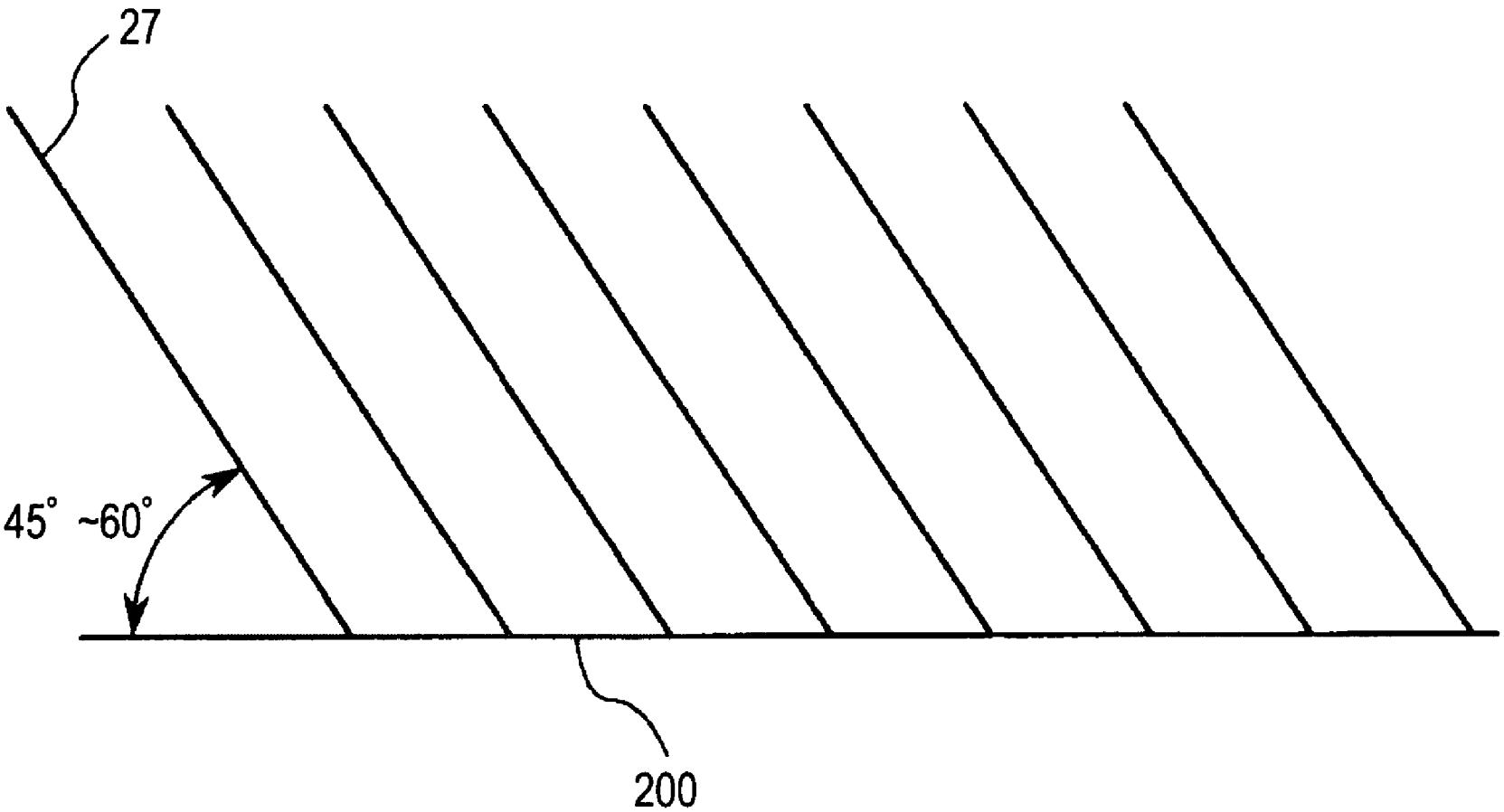
FIG. 13 is an explanatory view for illustrating an oblique raising state of piles in the brushing step.

In this embodiment, as shown in FIG. 13, the piles 27 are obliquely raised from the fabric base 200 at a raising angle of 45–60 degrees, created between the fabric base 200 and the piles 27.

Figure 2:
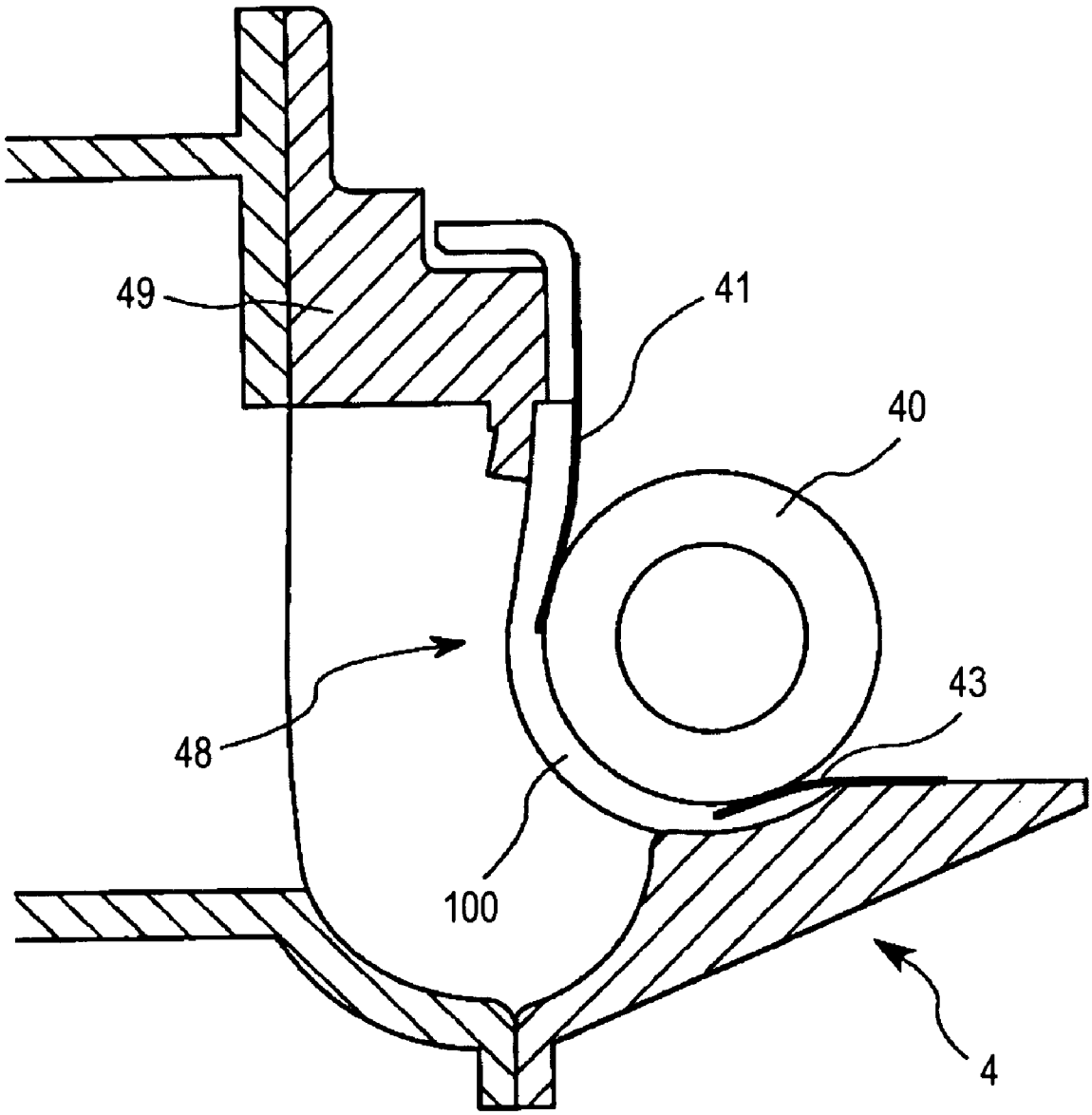
FIG. 2 is a sectional view showing a developing apparatus according to an embodiment of the present invention.

In the case where the piles 27 are not obliquely raised from the fabric base 200, referring to FIG. 2, the piles 27 are pressed by the developing roller 40 when the developing roller 40 is mounted onto the end portion seal member 100. As a result, the piles 27 are forced to fall down in various directions. For this reason, spacings between the piles 27 are created, and from the spacings, toner is leaked. Accordingly, in this embodiment, the piles 27 are obliquely raised from their root portions as shown in FIG. 13.

In the state that the brushing is effected, the piles are placed in the unraveled state, so that the pile length is still somewhat ununiform. For this reason, the warp pile fabric is again subjected to the shearing in a step S3, thus being further stabilized in its pile length.

Next, the warp pile fabric 200 is subjected to a polisher processing (polishing) in a step S4 in order to further stabilize the obliquely raised state of the piles 27 in the brushing step (step S2).

Figure 14:
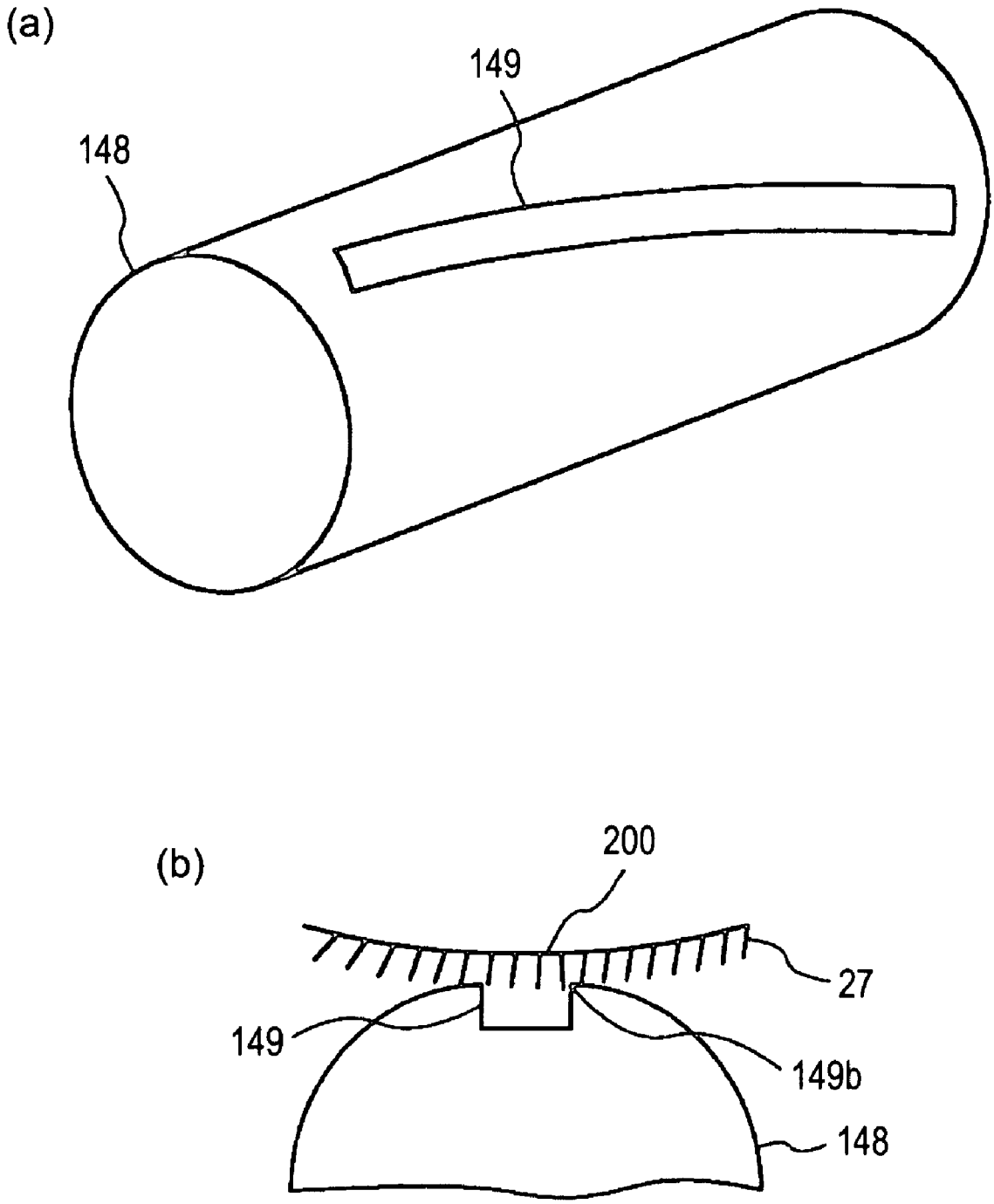
FIG. 14(*a*) is a perspective view showing an embodiment of a roller used in a polisher (polishing) step, and FIG. 14(*b*) is an explanatory view for illustrating an operation in the polisher step.

In the polisher (polishing) step S4, as shown in FIG. 14(*a*), a roller 148 having a diameter of about 500 mm is prepared. The surface of the roller 148 is provided with a helical groove 149. As shown in FIG. 14(*b*), the helical groove 149 has a recess portion when viewed from the side of the roller 148. The warp pile fabric 200 is caused to contact the roller 148 which is rotated at high speed, whereby the piles 27 are placed in such a state that they are uniformly raised by being frictionally passed through an edge portion 149*b* of the groove 149. Further, the piles 27 can also be obliquely raised from the fabric base 200. Accordingly, the obliquely raised state of the piles 27 is further stabilized.

Figure 15:
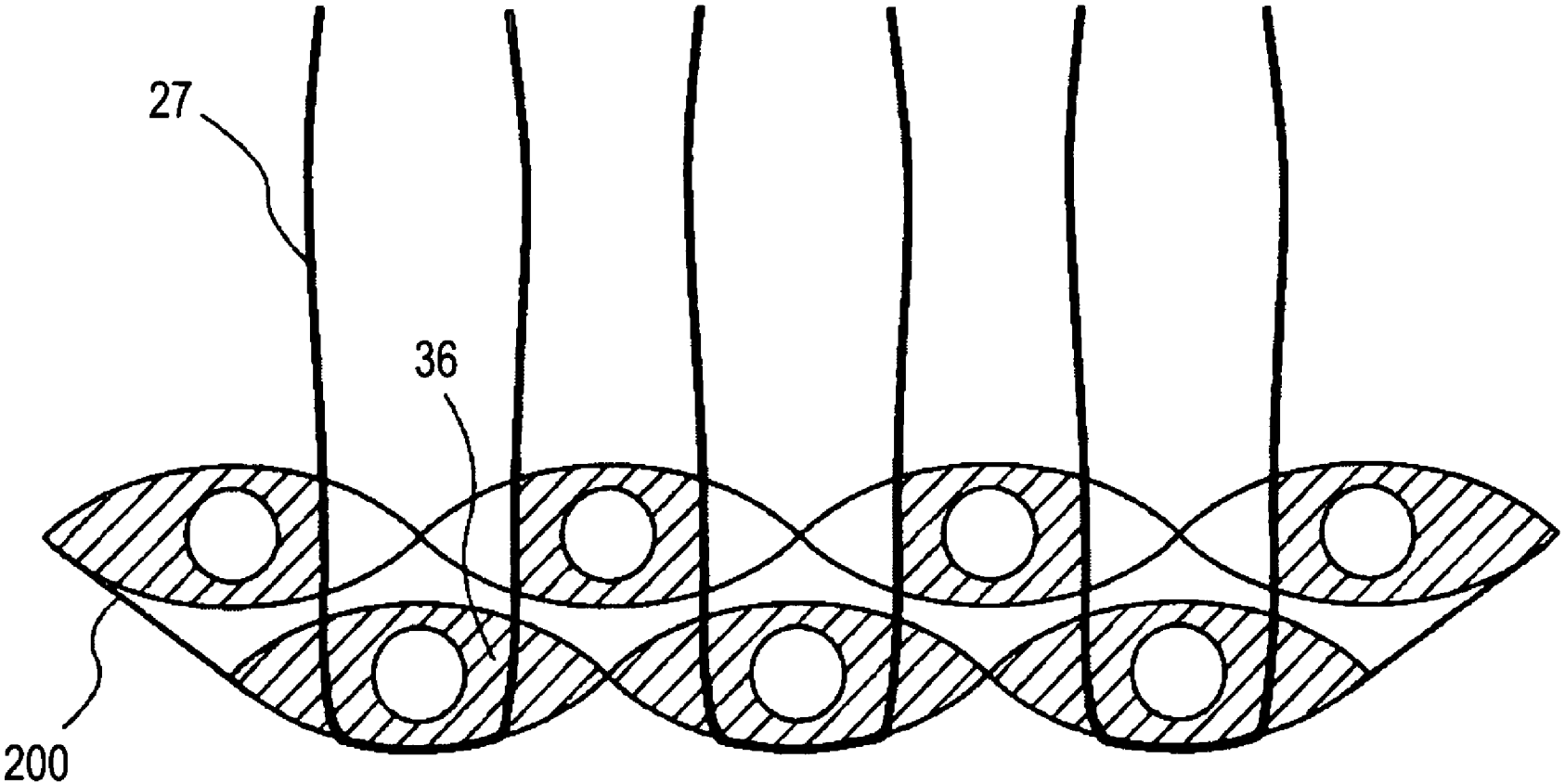
FIG. 15 is an explanatory view for illustrating an operation in a coating step.

Thereafter, in a step S5, the oblique raised state and the length of the piles 27 are still further stabilized through the shearing and the brushing. Then, in a step S6, a coating treatment is effected on the back surface of the warp pile fabric. This coating step will be described with reference to FIG. 15. From the back side of the fabric base 200 of the warp pile fabric, an adhesive 36 or the like is applied onto the back surface of the fabric base 200 by an applicator roller (not shown). At that time, as shown in FIG. 15, the adhesive 36 is placed in a state that the fabric base 200 is impregnated with the adhesive 36. By effecting the coating treatment, the piles 27 are prevented from coming off the fabric base 200.

Thereafter, in a step S7, the warp pile fabric 200 is further subjected to the brushing and the shearing to be further stabilized in its obliquely raised state and pile length. As a result, the warp pile fabric 200 is placed in a finished state as the warp pile fabric. The piles 27 finally have a pile length of not less than 3.2 mm and provides the warp pile fabric 200 generally called "moquette".

Then, in a step S8, a double-faced adhesive tape is applied onto the back surface of the warp pile fabric 200. More specifically, this tape is used for adhering the seal member 100 to the developer container 49 etc., at the time of using the warp pile fabric 200 as the seal member 100. However, in the coating state, the fabric base 200 is hardened by the adhesive 36. In other words, the back surface of the fabric base 200 becomes a firm uneven surface. As a result, when the double-faced adhesive tape is applied onto the fabric base 200, the adhesive surface area of the adhesive tape onto the fabric base 200 is liable to be decreased to lower the adhesive force. For this reason, frictioning is performed at the back surface of the fabric base 200.

Figure 16:
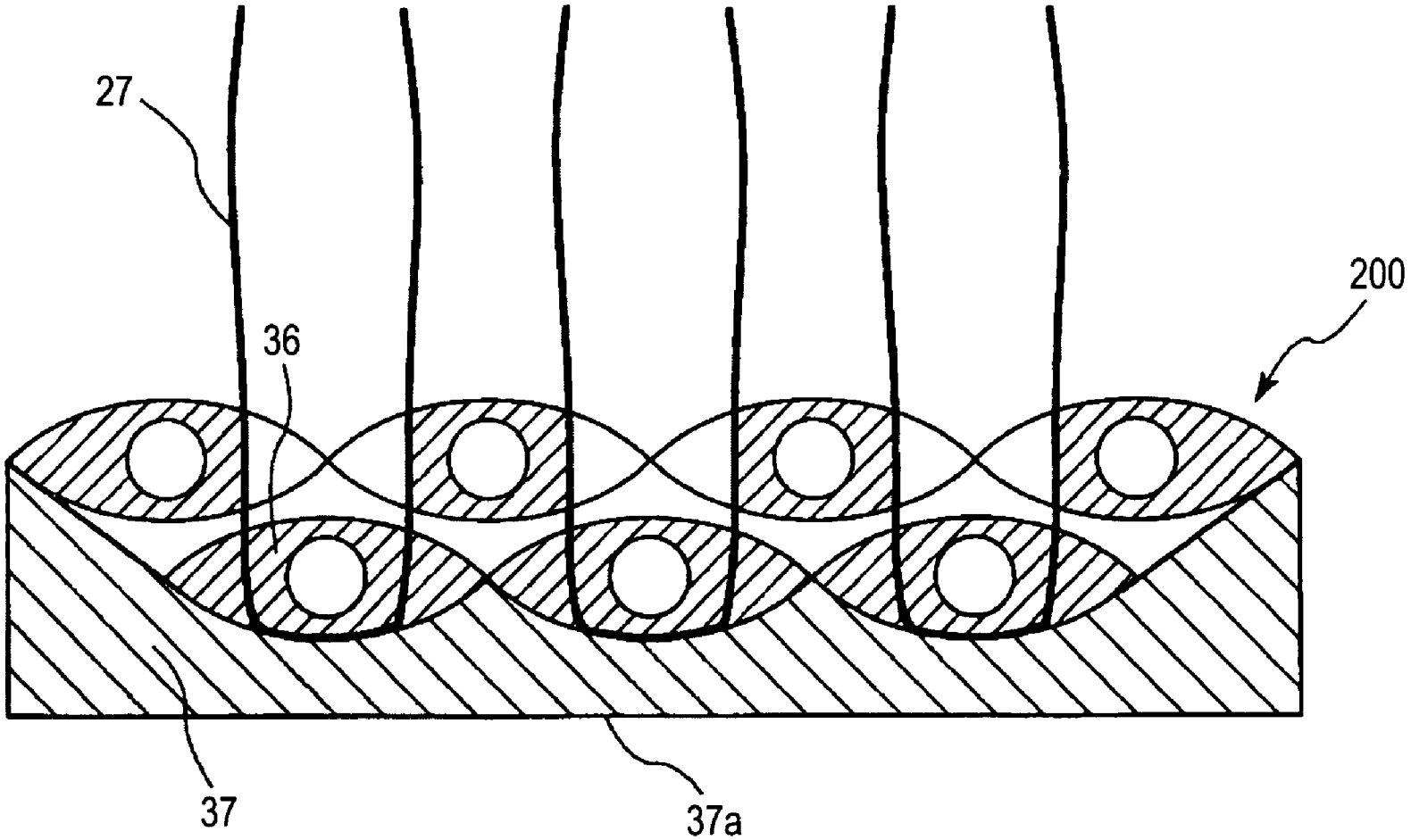
FIG. 16 is an explanatory view for illustrating an operation in a frictioning step.

As shown in FIG. 16, in the frictioning step (step S8), an isoprene rubber (IR) adhesive 37 as a the double-faced adhesive tape, is applied onto the back surface of the fabric base 200 by an application roller (not shown). The IR adhesive 37 has a high viscosity, so that it is in such a state that it is coated on the back surface of the fabric base 200 without being impregnated therein. The IR adhesive 37 has a surface 37*a* which is placed in a smooth (flat) state. Accordingly, it is possible to retain the adhesive force between the double-faced adhesive tape and the fabric base 200. As a result, the adhesive tape can be stably adhered to the fabric base 200.

By performing all the above-described steps S1 to S8, the warp pile fabric 200 which has a smoothness and a reinforced adhesiveness to the developing apparatus 4, is completed. The thus-improved warp pile fabric 200 is finished in a state that it has a weight per unit area of not less than 810 g/cm$^2$.

In the present invention, the order of the above described steps is not limited to that in the case of the above-described warp pile fabric 200 but may be appropriately changed depending on weaving conditions, such as the density, the number of denier, and the pile length.

The above-finished warp pile fabric 200 is extruded in a desired dimension in a step S9 and used as the seal member 100.

The extrusion of the seal member 100 from the warp pile fabric 200 is performed as follows.

The seal member 100 is extruded in a state that the direction of pile yarns 27 is inclined in a range of 40–50 degrees toward the rotation direction of the developing roller 40. By doing so, when the developing roller 40 is mounted on the seal member 100 and rotated, the direction of the piles (pile yarns) 27 is prevented from being unintendedly changed with the rotation of the developing roller 40.

Figure 17:
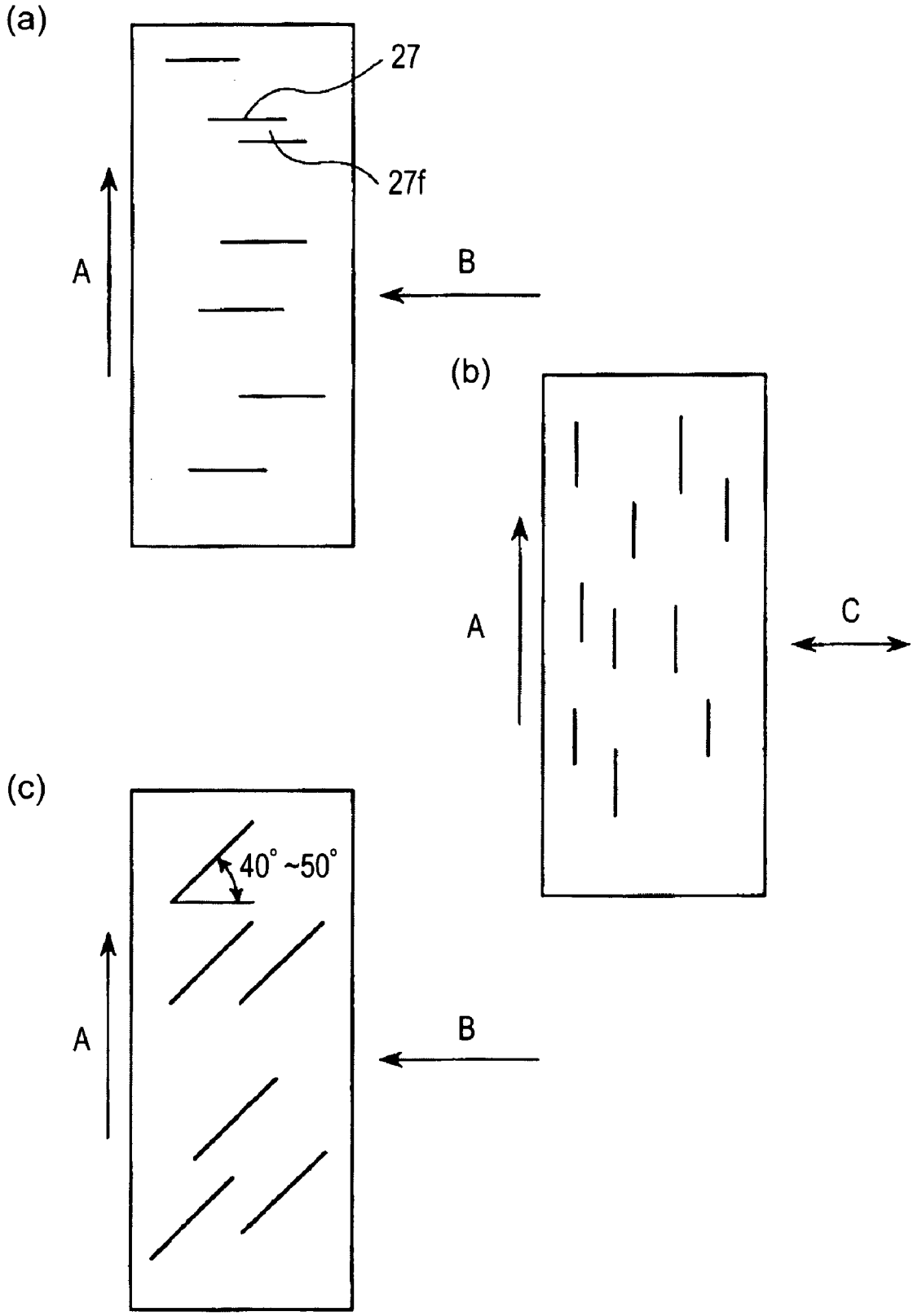
FIGS. 17(*a*), 17(*b*) and 17(*c*) are explanatory views showing a state of piles in a seal member extrusion step.

As shown in FIG. 17(*a*), in an example, the piles 27 are inclined in a direction perpendicular to a rotation direction, indicated by an arrow A, of the developing roller 40. In other words, the piles 27 are inclined in parallel with an entering direction B of toner. As a result, a spacing 27*f* is liable to be created between adjacent piles 27, and toner readily passes through the spacing 27*f*.

In another example, as shown in FIG. 17(*b*), the piles 27 are inclined in parallel with the rotation direction A of the developing roller 40. As a result, when the developing roller 40 is somewhat moved toward an axial direction indicated by a double-pointed arrow C during mounting of the developing roller 40, the piles 27 are directed toward a random direction with respect to the toner entering direction. Also in this state, the toner is more liable to pass through the seal member.

Accordingly, in this embodiment, as shown in FIG. 17(*c*), the piles 27 are inclined 40–50 degrees from the toner entering direction B toward the rotation direction A of the developing roller 40. As a result, the piles 27 are stably inclined in a direction such that a sealing performance of the seal member can be retained effectively.

As described above, the warp pile fabric 200 is subjected to the processing steps including S1: shearing, S2: brushing, S3: shearing, S4: polishing, S5: shearing and brushing, S6: coating, S7: brushing and shearing, S8: frictioning and seal adhesion, and S9: extrusion.

The thus finished seal member 100 (through the steps S1 to S9) is set to have a repulsive force of not more than 500 g. More specifically, a seal member 100 extruded to have a surface area of 178 mm$^2$ is set to have a repulsive force of not more than 500 g when it is pressed by a circular metal measuring head having a diameter of 60 mm until it has a thickness of 2.5 mm.

The thus prepared seal member 100 is used as an end portion seal 100 for the developing apparatus 4. This seal member 100 is flexibly deformed even at a portion having a difference in level, such as a mounting portion at an end portion of the developing blade 41. As a result, the seal member blocks a spacing with reliability to seal the toner.

Figure 18:
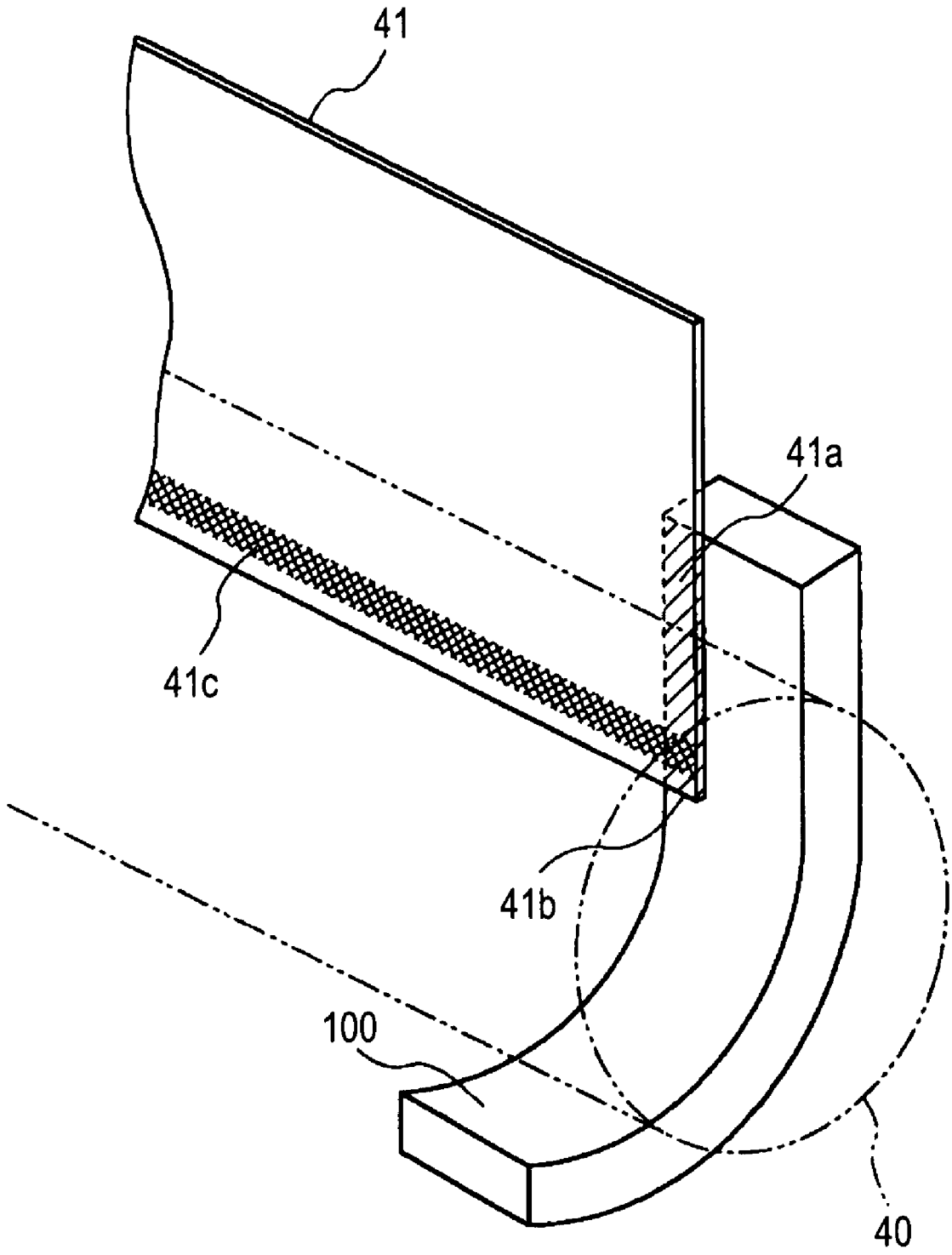
FIG. 18 is an explanatory view showing a mounting state of a seal member to a developing apparatus.

Such a portion will be described with reference to FIG. 18. The end portion of the developing blade 41 is placed in a state that it runs on the seal member 100 at a developing blade 41 abutting portion 41*a*.

When the developing roller 40 is mounted, the developing blade 41 contacts the developing roller 40 at a developing roller abutting portion 41*c* under pressure. As a result, only the developing blade 41 abutting portion 41*a* of the (end portion) seal member 100 is pressed, whereby a spacing is created at a boundary portion 41*b*. However, the end portion seal 100 comprising the seal member 100 using the above described improved warp pile fabric 200 is flexibly deformed even at the timing of such pressing. For this reason, the spacing is not created at the boundary portion 41*b*. Accordingly, the toner is prevented from being leaked from the boundary portion 41*b*. Further, at that time, the seal 100 exhibits its sealing performance with respect to also the toner entering it from the back side of the developing blade 41.

As described above, the seal member using the warp pile fabric which has been subjected to the above described processing retains its good sealing performance with respect to toner having a smaller particle size.

The seal member 100 comprising the warp pile fabric of this embodiment as its material is mounted, as the end portion seal, in the image forming apparatus 110 shown in FIG. 3. The image forming apparatus 110 is subjected to an image formation test on 4000 sheets at a high process speed of 180 mm/s. Even after the image formation test on 4,000 sheets, the seal member 100 can retain a performance of suppressing toner scattering from the developing apparatus 4. The image forming apparatus provides a good image without causing a damage of the developing roller 40, such as surface wearing thereof.

In this embodiment, with respect to the warp pile fabric 200 which has been formed through the V pile weave providing a V shaped fabric texture of piles 27 and subjected to the processing as shown in the flow chart of FIG. 8, the fineness of the piles 27 per one pile yarn, i.e., the number of denier is controlled in the range from not less than 250 to not more than 350. By doing so, the firmness of the piles per one pile yarn is reduced to prevent the 9 damage on the developer carrying member, such as the developing roller, even in a high speed image forming apparatus.

A continuous image formation test (durability test) was performed as Experiment 1 by using the various seal members 100 using warp pile fabrics 200 having various combinations of the number of deniers (per one pile 27), the fiber densities, and the pile densities. Evaluation was performed with respect to a sealing performance and a state of damage to the developing roller 40 by the seal member 100.

EXPERIMENT 1

Eight warp pile fabrics No. 1 to No. 8 shown below were prepared as samples for end portion seals 100.

(Warp Pile Fabric)

No. 1: a conventional warp pile fabric having a number of denier (per one pile 27) of 530 denier (D), a fiber density of 332,000 fibers/inch$^2$, and a pile density of 1,050 piles/inch$^2$.

No. 2: a warp pile fabric having a number of denier of 330 D, a fiber density of 690,000 fibers/inch$^2$, and a pile density of 2,100 piles/inch$^2$.

No. 3: a warp pile fabric having a number of denier of 350 D, a fiber density of 251,000 fibers/inch$^2$, and a pile density of 1,260 piles/inch$^2$.

No. 4: a warp pile fabric having a number of denier of 180 D, a fiber density of 672,000 fibers/inch$^2$, and a pile density of 2,100 piles/inch$^2$.

No. 5: a warp pile fabric having a number of denier of 400 D, a fiber density of 265,440 fibers/inch$^2$, and a pile density of 1.050 piles/inch$^2$.

No. 6: a warp pile fabric having a number of denier of 330 D, a fiber density of 672,000 fibers/inch$^2$, and a pile density of 1,680 piles/inch$^2$.

No. 7: a warp pile fabric having a number of denier of 330 D, a fiber density of 265,440 fibers/inch$^2$, and a pile density of 840 piles/inch$^2$.

No. 8: a warp pile fabric having a number of denier of 200 D, a fiber density of 265,440 fibers/inch$^2$, and a pile density of 1,050 piles/inch$^2$.

The durability test was performed in the following manner.

Each of the seal member 100 prepared by using the above described warp pile fabrics No. 1 to No. 8 was mounted, as the end portion seal 100 for the developing apparatus 4, in the image forming apparatus shown in FIG. 3, and the image forming apparatus was subjected to continuous printing on 4,000 sheets at a high process speed of 180 mm/s in an ordinary environment. After the continuous printing on 4,000 sheets, the sealing performance was evaluated and the state of damage to the developing roller 40 was observed.

The results are shown in Table 1.

TABLE 1

| File fabric | Number of denier per one pile | Pile density (piles/inch$^2$) | Fiber density (fibers/inch$^2$) | Sealing performance *1 | Damage of roller *2 |
|---|---|---|---|---|---|
| No. 1 | 530 | 1050 | 332000 | B | B |
| No. 2 | 330 | 2100 | 690000 | A | B |
| No. 3 | 350 | 1260 | 251000 | C | A |
| No. 4 | 180 | 2100 | 672000 | C | A |
| No. 5 | 400 | 1050 | 265440 | A | B |
| No. 6 | 330 | 1680 | 672000 | A | A |
| No. 7 | 330 | 840 | 265440 | A | A |
| No. 8 | 200 | 1050 | 255440 | A | A |

*1, *2: The sealing performance and the state of damage to the developing roller 40 were evaluated as follows.
A: Satisfactory performance (in terms of sealing performance or damage prevention).
B: There is a possibility that the performance is not satisfactory when various irregularities are taken into consideration.
C: Very unsatisfactory performance.

The conventional warp pile fabric No. 1 has the number of denier of 530 D and the fiber density of 332,000 fibers/inch$^2$. However, the sealing performance and the damage to the developing roller 40 were both evaluated as "B".

The firmness of the piles 27 is decreased by reducing the number of denier of the piles 27. The warp pile fabric No. 2 having the smaller number of denier but having the fiber density of 690,000 fibers/inch$^2$ increased to compensate for a lowering in sealing performance by the narrowed piles 27 satisfies the sealing performance. However, the fiber density is excessively increased, so that the effect of the decrease in firmness by the narrowed piles 27 cannot be attained. Further, the damage to the developing roller 40 is being caused to occur. For this reason, the damage to the developing roller 40 is evaluated as "B".

In order to suppress the damage to the developing roller 40 with respect to the warp pile fabric No. 2, its fiber density is decreased to 251,000 fibers/inch$^2$, and the number of denier is increased to 350 D in order to compensate for the sealing performance. The thus prepared warp pile fabric No. 3 is, however, excessively lowered in the number of denier, so that the sealing performance cannot be satisfied.

With respect to the warp pile fabric No. 4 which has the number of denier (fineness of piles 27) decreased to 180 D for sufficiently decreasing the firmness and has the fiber density of 672,000 fibers/inch$^2$, the damage to the developing roller 40 is evaluated as "A". However, the number of denier is excessively lowered, so that the sealing performance cannot be satisfied.

In order to improve the sealing performance, the fineness of piles 27 is increased to 400 D, and the fiber density is decreased to 265,440 fibers/inch$^2$ in order to avoid the damage to the developing roller 40. The thus prepared warp pile fabric No. 5 satisfies the sealing performance. However, the damage to the developing roller 40 is being caused to occur. For this reason, the damage to the developing roller 40 is evaluated as "B".

The warp pile fabric No. 6 (according to the present invention) having the fineness of piles 27 of 330 D and the fiber density of 672,000 fibers/inch$^2$ satisfies both the sealing performance and the damage prevention performance to the developing roller 40.

The warp pile fabric No. 7 (according to the present invention) having the fineness of piles 27 of 330 D and the fiber density of 265,440 fibers/inch$^2$ satisfies both the sealing performance and the damage prevention performance to the developing roller 40.

The warp pile fabric No. 8 (according to the present invention) having the fineness of piles 27 of 200 D) and the fiber density of 265,440 fibers/inch$^2$ satisfies both the sealing performance and the damage prevention performance to the developing roller 40.

As apparent from Table 1, in the seal member sharing the fiber density (representing the number of fibers per unit area) of not less than 260,000/inch$^2$ and not more than 680,000/inch$^2$, by providing the warp pile fabric with the number of denier (per one pile yarn) of not less than 200 D and not more than 350 D, the resultant seal members are improved in sealing performance compared with the conventional seal member. Further, the seal members also cause less damage to the developing roller 40 than the conventional seal member. The lower limit of the number of denier is determined on the basis of a lower limit condition permitting actual weaving of piles by a weaving machine.

Other than Experiment 1 described above, warp pile fabrics having combinations of the fiber density in the range of not less than 260,000/inch$^2$ and not more than 680,000/inch$^2$ and the number of denier (per one pile yarn) of not less than 200 D and not more than 350 D were similarly prepared and evaluated. As a result, the resultant seal members sufficiently satisfy not only the sealing performance but also the damage prevention performance to the developing roller, even in the case of using the high speed image forming apparatus.

As described hereinabove, according to the present invention, there are provided a seal member, a developing apparatus, a process cartridge, and an image forming apparatus, wherein the seal member is formed of a warp pile fabric through a V pile weave providing a V-shaped pile fabric texture and has a fiber density, representing a number of fibers per unit area, of not less than 260,000/inch$^2$ and not more than 680,000/inch$^2$ and a number of denier per one pile of not less than 200 denier and not more than 350 denier. As a result, it is possible to suppress damage to the developer carrying member and provide a good sealing performance.

This application claims priority from Japanese Patent Application No. 373697/2003 filed Oct. 31, 2003, which is hereby incorporated by reference.

What is claimed is:

1. A developing apparatus for developing an electrostatic latent image formed on an image bearing member, comprising:

a developer container containing developer; and a developer carrying member configured and positioned to carry the developer and to convey the developer to the image bearing member; and a seal member, disposed at an opening of said developer container, and configured to seal said developer container at the boundary between said developer container and said developer carrying member, said sealing member comprising:

a warp pile fabric, wherein said sealing member is formed by a V pile weave providing a V-shaped pile fabric texture and has a fiber density, representing a number of fibers per unit area, of not less than 260,000/inch$^2$ and not more than 680,000/inch$^2$ and a number of denier per one pile of not less than 200 denier and not more than 350 denier.

2. A process cartridge detachably mountable to a main assembly of an image forming apparatus, comprising:

an image bearing member having a surface on which an electrostatic latent image is formed; and a developing apparatus, according to claim 1, configured and positioned to develop the electrostatic latent image.

3. An image forming apparatus for forming an image on a recording medium, comprising:

an image bearing member having a surface on which an electrostatic latent image is formed; and a developing apparatus, according to claim 1, configured and positioned to develop the electrostatic latent image.

4. An image forming apparatus for forming an image on a recording medium, comprising:

means for forming an electrostatic latent image on an image bearing member, and a process cartridge according to claim 2, detachably mountable to said image forming apparatus.

5. A developing apparatus according to claim 1, wherein the developer carrying member is a rotating developer carrying member, wherein said warp pile fabric comprises a plurality of pile yarns, and wherein the plurality of pile yarns are inclined within a predetermined range of angles with respect to a direction in which the developer enters the sealing member from the rotating developer carrying member that substantially reduces the amount of developer passing through the sealing member.

6. A developing apparatus according to claim 5, wherein the predetermined range of angles is substantially between 40 degrees and 50 degrees.

* * * * *

UNITED STATES PATENT AND TRADEMARK OFFICE

CERTIFICATE OF CORRECTION

PATENT NO. : 7,088,938 B2
APPLICATION NO. : 10/878600
DATED : August 8, 2006
INVENTOR(S) : Koji Hashimoto et al.

It is certified that error appears in the above-identified patent and that said Letters Patent is hereby corrected as shown below:

ON THE TITLE PAGE, AT ITEM (56), RC:
Foreign Patent Documents, "2002201461 A" should read --2002-201461 A--.

COLUMN 2:
Line 26, "place" should read --placed--.
Line 66, "(Dtex)" should read --(Dtex))--.

COLUMN 5:
Line 25, "contacts" should read --contact--.

COLUMN 7:
Line 29, "embodiments," should read --embodiment,--.

COLUMN 8:
Line 14, "have" should read --having--.
Line 41, "pun" should read --spun--.

COLUMN 9:
Line 22, "show" should read --shown--.
Line 45, "above" should read --above- --.

COLUMN 11:
Line 2, "the" should be deleted.
Line 18, "above described" should read --above-described--.

COLUMN 12:
Line 16, "above" should read --above- --.
Line 25, "above described" should read --above-described--.
Line 45, "9" should be deleted.

COLUMN 13:
Line 21, "above" should read --above- --.

UNITED STATES PATENT AND TRADEMARK OFFICE

CERTIFICATE OF CORRECTION

PATENT NO. : 7,088,938 B2
APPLICATION NO. : 10/878600
DATED : August 8, 2006
INVENTOR(S) : Koji Hashimoto et al.

It is certified that error appears in the above-identified patent and that said Letters Patent is hereby corrected as shown below:

COLUMN 14:
Line 32, "200 D)" should read --200 D--.

Signed and Sealed this

Seventeenth Day of February, 2009

JOHN DOLL
*Acting Director of the United States Patent and Trademark Office*